US011177605B2

(12) United States Patent
Miyamura

(10) Patent No.: US 11,177,605 B2
(45) Date of Patent: Nov. 16, 2021

(54) CONNECTOR, JIG AND METHOD FOR MANUFACTURING CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventor: Tetsuya Miyamura, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/758,603

(22) PCT Filed: Nov. 8, 2018

(86) PCT No.: PCT/JP2018/041451
§ 371 (c)(1),
(2) Date: Apr. 23, 2020

(87) PCT Pub. No.: WO2019/093412
PCT Pub. Date: May 16, 2019

(65) Prior Publication Data

US 2021/0184387 A1 Jun. 17, 2021

(30) Foreign Application Priority Data

Nov. 13, 2017 (JP) ..... JP2017-218095

(51) Int. Cl.
*H01R 13/426* (2006.01)
*H01R 13/436* (2006.01)
(Continued)

(52) U.S. Cl.
CPC ..... *H01R 13/4362* (2013.01); *H01R 13/514* (2013.01); *H01R 43/20* (2013.01)

(58) Field of Classification Search
CPC ..... H01R 13/4361; H01R 13/4362
(Continued)

(56) References Cited

U.S. PATENT DOCUMENTS 4,767,361 A * 8/1988 Hoshino ..... H01R 13/422 439/596
5,355,583 A * 10/1994 Osumi ..... H01R 43/22 29/33 M
(Continued)

FOREIGN PATENT DOCUMENTS

JP 06-029082 4/1994
JP 2000-150052 5/2000
(Continued)

OTHER PUBLICATIONS

Official Communication issued in International Bureau of WIPO Patent Application No. PCT/JP2018/041451, dated Feb. 5, 2019.

*Primary Examiner* — Neil Abrams
(74) *Attorney, Agent, or Firm* — Greenblum & Bernstein, P.L.C.

(57) ABSTRACT

A retainer mounted in a connector housing includes first contact portions configured to move the retainer from a full locking position to a partial locking position by coming into contact with tip portions of first protrusions of a jig, and second contact portions configured to move the retainer from the partial locking position to the full locking position by coming into contact with second protrusions of the jig. In use the connector housing may be moved into a recess of the jig and a projection in the recess may cause the retainer to move outwardly to allow terminal insertion. The connector housing may be then move outwardly of the recess to cause
(Continued)

a jig projection to move the retainer to a full locking position.

11 Claims, 22 Drawing Sheets

(51) Int. Cl.
*H01R 13/514* (2006.01)
*H01R 43/20* (2006.01)

(58) Field of Classification Search
USPC ..... 439/752; 876/876, 884, 749
See application file for complete search history.

(56) References Cited

U.S. PATENT DOCUMENTS 5,403,213 A * 4/1995 Inaba ..... H01R 13/4362 439/598
5,438,748 A 8/1995 Matsuzawa
5,528,821 A 6/1996 Matsuzawa
5,797,773 A * 8/1998 Kobayashi ..... H01R 13/4361 439/752
6,183,314 B1 * 2/2001 Wada ..... B29C 45/006 439/752
6,264,497 B1 * 7/2001 Murakami ..... H01R 4/2433 439/417
6,296,531 B1 * 10/2001 Nagamine ..... H01R 13/4362 439/752
6,435,920 B2 * 8/2002 Kashiyama ..... H01R 13/4362 439/595
7,278,890 B1 * 10/2007 Smutny ..... H01R 13/4361 439/752
7,347,732 B2 * 3/2008 Ohtaka ..... H01R 13/4362 439/595
7,661,999 B2 * 2/2010 Horiuchi ..... H01R 13/506 439/752
8,684,773 B2 * 4/2014 Kobayashi ..... H01R 13/4362 439/752
9,083,114 B2 * 7/2015 Muro ..... H01R 13/4362
10,566,729 B2 * 2/2020 Rangi ..... H01R 43/18
10,615,532 B2 * 4/2020 Miyamura ..... H01R 13/42
2002/0133938 A1 9/2002 Kashiyama et al.
2002/0137402 A1 9/2002 Kashiyama et al.
2011/0217865 A1 9/2011 Mito
2020/0274279 A1 * 8/2020 Miyamura ..... H01R 13/4362
2021/0184387 A1 * 6/2021 Miyamura ..... H01R 13/4362

FOREIGN PATENT DOCUMENTS

JP 2001-345140 12/2001
JP 2005-158444 6/2005
JP 2010-118255 5/2010
JP 2015-198004 11/2015
JP 2017-054585 3/2017
WO 2017/043278 3/2017

* cited by examiner

CONNECTOR, JIG AND METHOD FOR MANUFACTURING CONNECTOR

TECHNICAL FIELD

A technique disclosed in this specification relates to a connector in which a retainer is movable to a partial locking position and a full locking position using a jig.

BACKGROUND ART

Conventionally, a technique for moving a retainer mounted in a connector housing from a partial locking position to a full locking position using a jig is described, for example, in patent literature 1. The above jig is formed with a moving path in which the connector housing can slide. A pressing member for moving the retainer to the full locking position by coming into contact with the retainer partially locked to the connector housing when the connector housing slides in the moving path is arranged in the moving path.

According to the above technique, the pressing member comes into contact with the retainer and moves the retainer to the full locking position by pushing the connector housing into the moving path and sliding the connector housing in the moving path. In this way, a worker needs not directly operate the retainer with fingers. Thus, a burden of the worker is reduced.

CITATION LIST

Patent Literature

Patent Literature 1: Japanese Utility Model Publication No. H06-29082

SUMMARY OF INVENTION

Technical Problem

However, since the worker needs to perform an operation of pushing a connector into the jig to move the retainer from the partial locking position to the full locking position also with the above configuration, man-hours in a connector manufacturing process cannot be reduced. Thus, it has been desired to reduce the man-hours in the connector manufacturing process.

The technique disclosed in this specification was completed on the basis of the above situation and aims to reduce man-hours in a connector manufacturing process.

Solution to Problem

The technique disclosed in this specification is directed to a connector with a terminal, a connector housing including a cavity into which the terminal is inserted along an inserting direction, and a retainer to be mounted into the connector housing and movable between a partial locking position where the retainer is retracted from the cavity and the terminal is insertable into the cavity and a full locking position where the retainer projects into the cavity to retain and lock the terminal inserted into the cavity, the retainer including a first contact portion configured to move the retainer from the full locking position to the partial locking position by coming into contact with a tip portion of a first protrusion of a jig and a second contact portion configured to move the retainer from the partial locking position to the full locking position by coming into contact with a second protrusion of the jig.

The technique disclosed in this specification is directed to a jig for moving a retainer mounted into a connector housing including a cavity into which a terminal is inserted along an inserting direction between a partial locking position where the retainer is retracted from the cavity and the terminal is insertable into the cavity and a full locking position where the retainer projects into the cavity to retain and lock the terminal inserted into the cavity, the jig including a connector accommodation recess extending along the inserting direction and configured to accommodate the connector housing, a first protrusion provided in a front end part of the connector accommodation recess in the inserting direction, extending rearward with respect to the inserting direction and configured to move the retainer from the full locking position to the partial locking position by coming into contact with the retainer, and a second protrusion provided on a rear end part in the inserting direction on a side wall of the connector accommodation recess, projecting inwardly of the connector accommodation recess and configured to move the retainer from the partial locking position to the full locking position by coming into contact with the retainer.

The technique disclosed in this specification is directed to a method for manufacturing a connector with a terminal, a connector housing including a cavity into which the terminal is inserted along an inserting direction, and a retainer to be mounted into the connector housing and movable between a partial locking position where the retainer is retracted from the cavity and the terminal is insertable into the cavity and a full locking position where the retainer projects into the cavity to retain and lock the terminal inserted into the cavity, the method including mounting the retainer into the connector housing, moving the retainer to the partial locking position by inserting the connector housing having the retainer mounted therein into a connector accommodation recess provided in a jig to bring a first protrusion provided in a front end part of the connector accommodation recess in the inserting direction and extending rearward with respect to the inserting direction and the retainer into contact, inserting the terminal into the cavity along the inserting direction, and moving the retainer from the partial locking position to the full locking position by pulling the connector housing having the retainer and the terminal mounted therein out of the connector accommodation recess to bring a second protrusion provided on a rear end part in the inserting direction on a side wall of the connector accommodation recess and projecting inwardly of the connector accommodation recess and the retainer into contact.

According to the above configurations, the retainer can be moved to the partial locking position by mounting the connector housing assembled with the retainer into the jig. By removing the connector housing from the jig, the retainer can be moved to the full locking position. In this way, a worker needs not operate the retainer with his/her fingers in moving the retainer from the partial locking position to the full locking position, wherefore man-hours in a connector manufacturing process can be reduced.

The following modes are preferable as embodiments of the technique disclosed in this specification.

Preferably, the connector housing includes a retainer accommodation recess into which the retainer is mounted, the connector housing includes a receiving recess provided in a front end part located on a front side in the inserting direction and configured to receive the first protrusion, and the receiving recess communicates with the retainer accommodation recess.

According to the above configuration, if the first protrusion of the jig is inserted into the receiving recess, the first protrusion is also inserted into the retainer accommodation recess. In this way, the first contact portion of the jig can be brought into contact with the first contact portion of the retainer accommodated in the retainer accommodation recess by a simple operation of inserting the first contact portion into the receiving recess.

Preferably, the connector housing includes an end rib provided on a rear end part located on a rear side in the inserting direction and projecting outward in a direction intersecting the inserting direction, and the end rib includes a second protrusion avoiding recess configured to avoid interference with the second protrusion.

According to the above configuration, if the first protrusion of the jig is inserted into the receiving recess, the first protrusion is also inserted into the retainer accommodation recess. In this way, the first protrusion of the jig can be brought into contact with the first contact portion of the retainer accommodated in the retainer accommodation recess by a simple operation of inserting the first protrusion into the receiving recess.

Preferably, the jig is provided with a guide rib extending along the inserting direction, and the end rib includes a guide groove to be engaged with the guide rib.

According to the above configuration, the connector housing is guided into the connector accommodation recess along the inserting direction by the engagement of the guide rib and the guide groove.

Preferably, the retainer is provided with a guide rib avoiding recess configured to avoid interference with the guide rib with the retainer moved to the partial locking position.

According to the above configuration, the interference of the retainer and the guide rib of the jig can be suppressed with the retainer moved to the partial locking position.

Preferably, a bottom surface of the guide rib avoiding recess is formed to be flush with an outer surface of the connector housing with the retainer moved to the partial locking position.

According to the above configuration, the interference of the retainer and the guide rib of the jig can be reliably suppressed with the retainer moved to the partial locking position.

Preferably, the first protrusion includes a base portion on a front side in the inserting direction and a tip portion extending rearward with respect to the inserting direction from the base portion and narrower than the base portion, an inclined portion inclined with respect to the inserting direction is provided between the base portion and the tip portion, and the inclined portion comes into contact with the retainer.

According to the above configuration, the retainer can be reliably moved to the partial locking position by the contact of the inclined portion and the retainer.

Preferably, a guide rib extending along the inserting direction and configured to guide the connector housing into the connector accommodation recess by sliding in contact with the connector housing is provided on the side wall of the connector accommodation recess.

According to the above configuration, the connector housing can be reliably inserted into the connector accommodation recess along the inserting direction.

Preferably, the second protrusion is provided at a position projecting rearward with respect to the inserting direction from an inner surface of the connector accommodation recess.

According to the above configuration, the second protrusion is provided at the position projecting rearward with respect to the inserting direction from the inner surface of the connector accommodation recess. In this way, the second protrusion and the retainer can be reliably brought into contact.

Effect

According to the technique disclosed in this specification, it is possible to reduce man-hours in a connector manufacturing process.

EMBODIMENT OF INVENTION

Embodiment

One embodiment of the technique disclosed in this specification is described with reference to FIGS. 1 to 22. A connector 10 according to this embodiment includes female terminals 11 (an example of a terminal), a connector housing 12 for accommodating the female terminals 11 and a retainer 13 to be mounted into the connector housing 12 and movable between a full locking position and a partial locking position. In the following description, it is assumed that a Z direction is an upward direction, a Y-direction is a forward direction and an X-direction is a leftward direction. Only some of a plurality of members having the same shape may be denoted by a reference sign and the other members may not be denoted by the reference sign.

(Connector 10)

Figure 1:
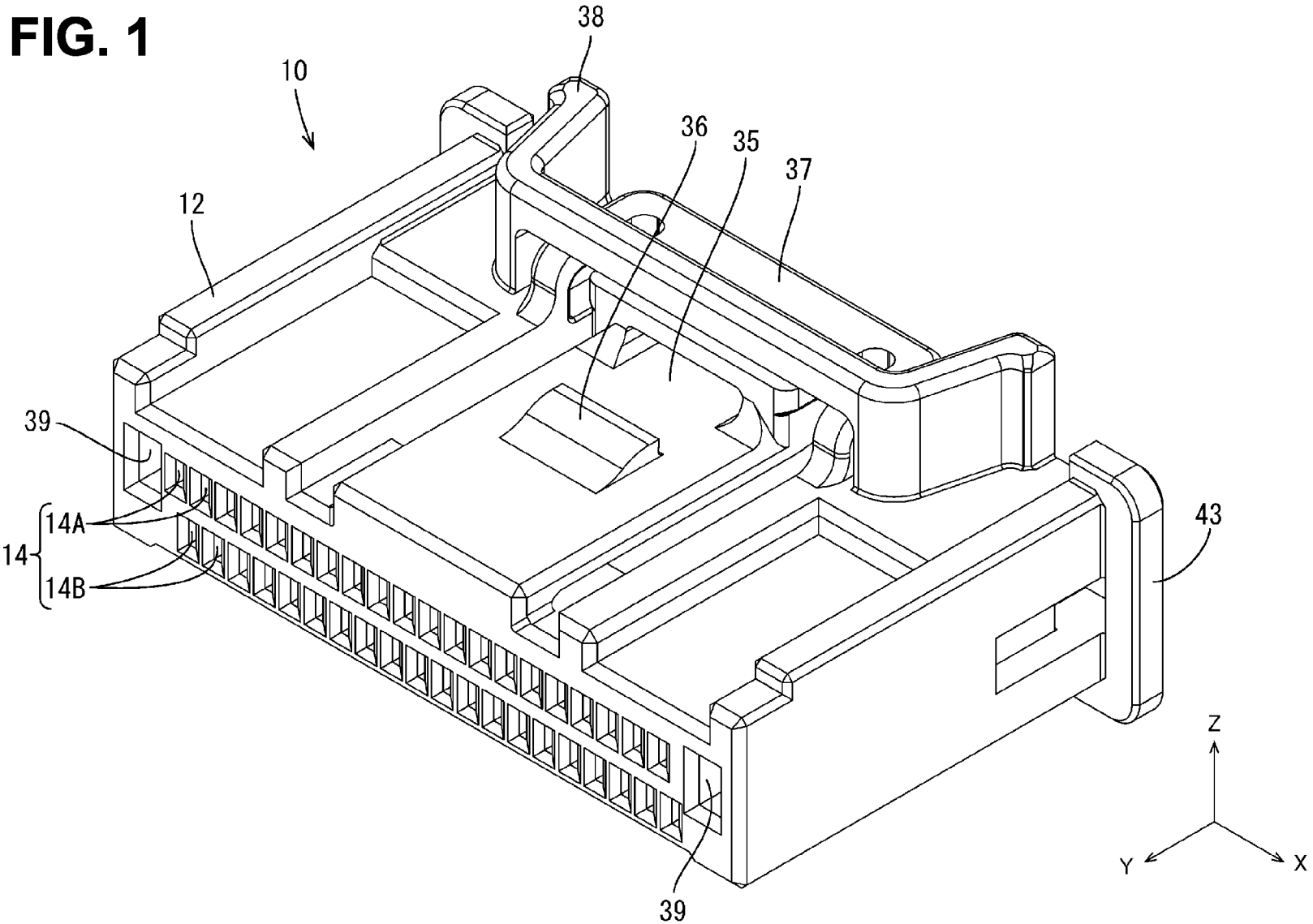
FIG. 1 is a perspective view showing a connector according to one embodiment.

As shown in FIG. 1, the connector housing 12 is made of insulating synthetic resin and has a substantially rectangular parallelepiped shape. The connector housing 12 is formed with a plurality of cavities 14 extending in a front-rear direction. The plurality of cavities 14 are arranged at intervals in a lateral direction and at intervals in a vertical direction in two upper and lower stages. An insertion hole 16 into which an unillustrated male terminal is inserted penetrates through a front wall 15 of the cavity 14 in a front-rear direction. A terminal insertion hole 17 open rearward is formed in a rear end part of the cavity 14.

Figure 2:
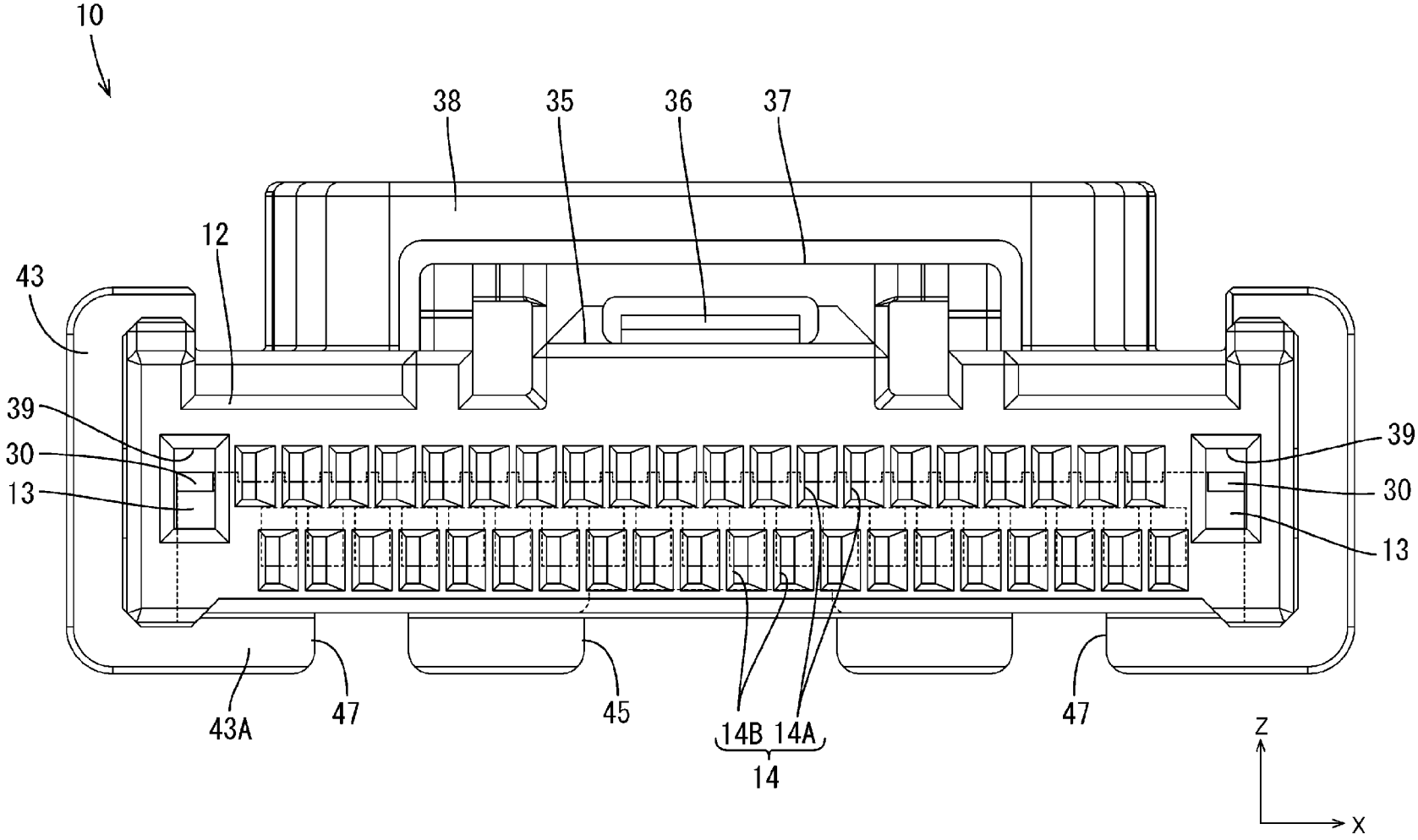
FIG. 2 is a front view showing the connector in which a retainer is mounted at a full locking position.

As shown in FIG. 2, the respective cavities 14B provided in the lower stage and the respective cavities 14A provided in the upper stage are not aligned in the vertical direction. In other words, the respective cavities 14B in the lower stage and the respective cavities 14A in the upper stage are shifted in the lateral direction and arranged in an offset manner. In the following description, the cavities 14B in the lower stage and the cavities 14A in the upper stage are referred to as the cavities 14 if these are not distinguished.

Figure 19:
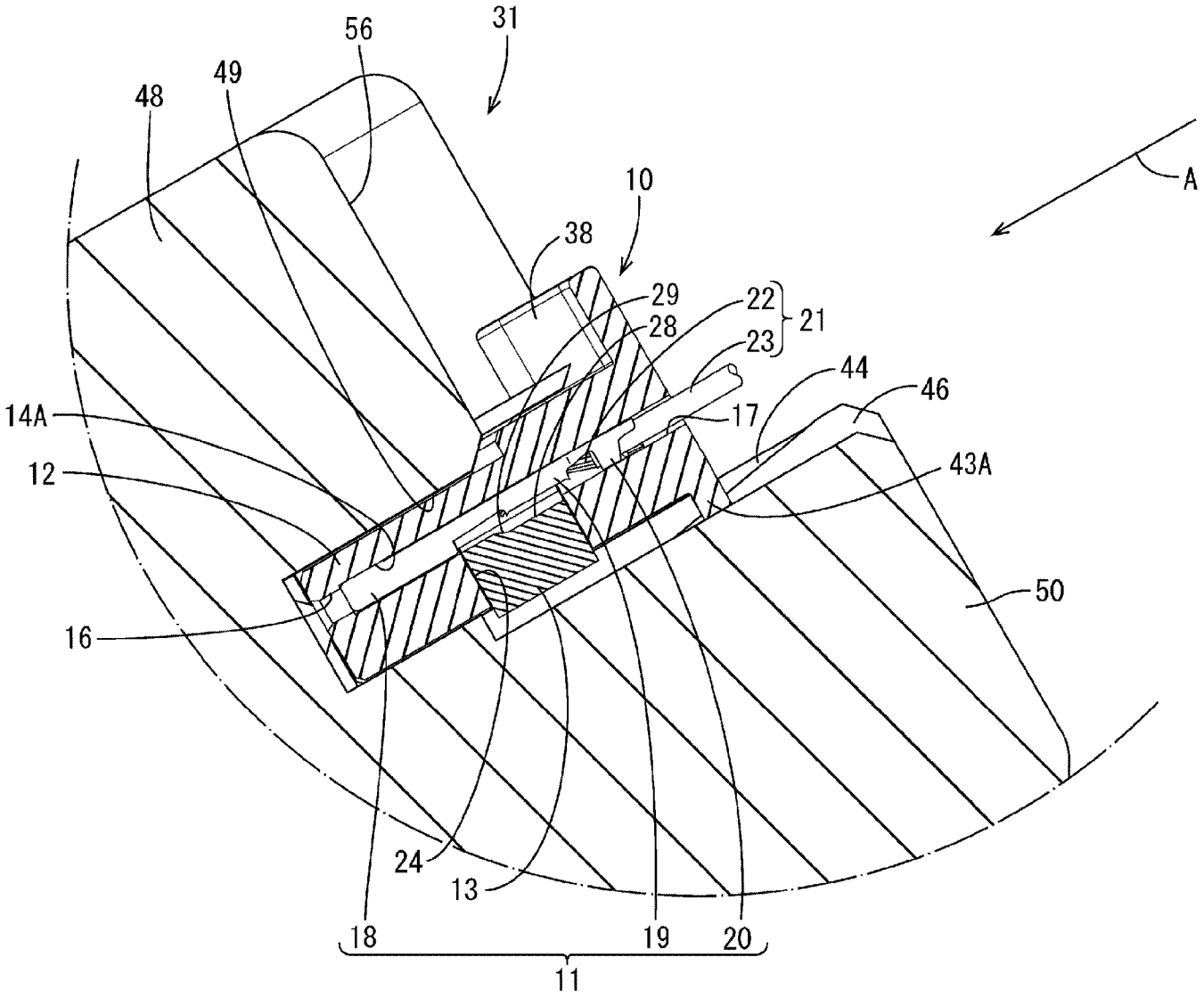
FIG. 19 is a section showing a state where a female terminal is inserted in the connector housing.

As shown in FIG. 19, the female terminal 11 is inserted into the cavity 14 through the terminal insertion hole 17. The female terminal 11 is formed by press-working a metal plate material. An arbitrary metal such as copper, copper alloy, aluminum or aluminum alloy can be selected according to need as a metal constituting the female terminal 11. A plating layer may be formed on a surface of the female terminal 11. An arbitrary metal such as tin, nickel or silver can be appropriately selected according to need as a metal for forming the plating layer. A tin plating layer is formed on the surface of the female terminal 11 according to this embodiment.

The female terminal 11 includes a connecting tube portion 18 into which the male terminal is inserted from front, a wire barrel 19 extending rearward from the connecting tube portion 18 and an insulation barrel 20 extending rearward from the wire barrel 19.

The connecting tube portion 18 is provided with a tongue piece (not shown) configured to resiliently contact the male terminal. The male terminal is resiliently sandwiched between the tongue piece and an inner wall of the connecting tube portion 18, whereby the female terminal 11 and the male terminal are electrically connected.

The wire barrel 19 is crimped to wind around the outer periphery of a core 22 exposed from an end of a wire 21. In this way, the wire 21 and the female terminal 11 are electrically connected. The insulation barrel 20 is crimped to wind around the outer periphery of an insulation coating 23 covering the outer periphery of the core 22.

Figure 4:
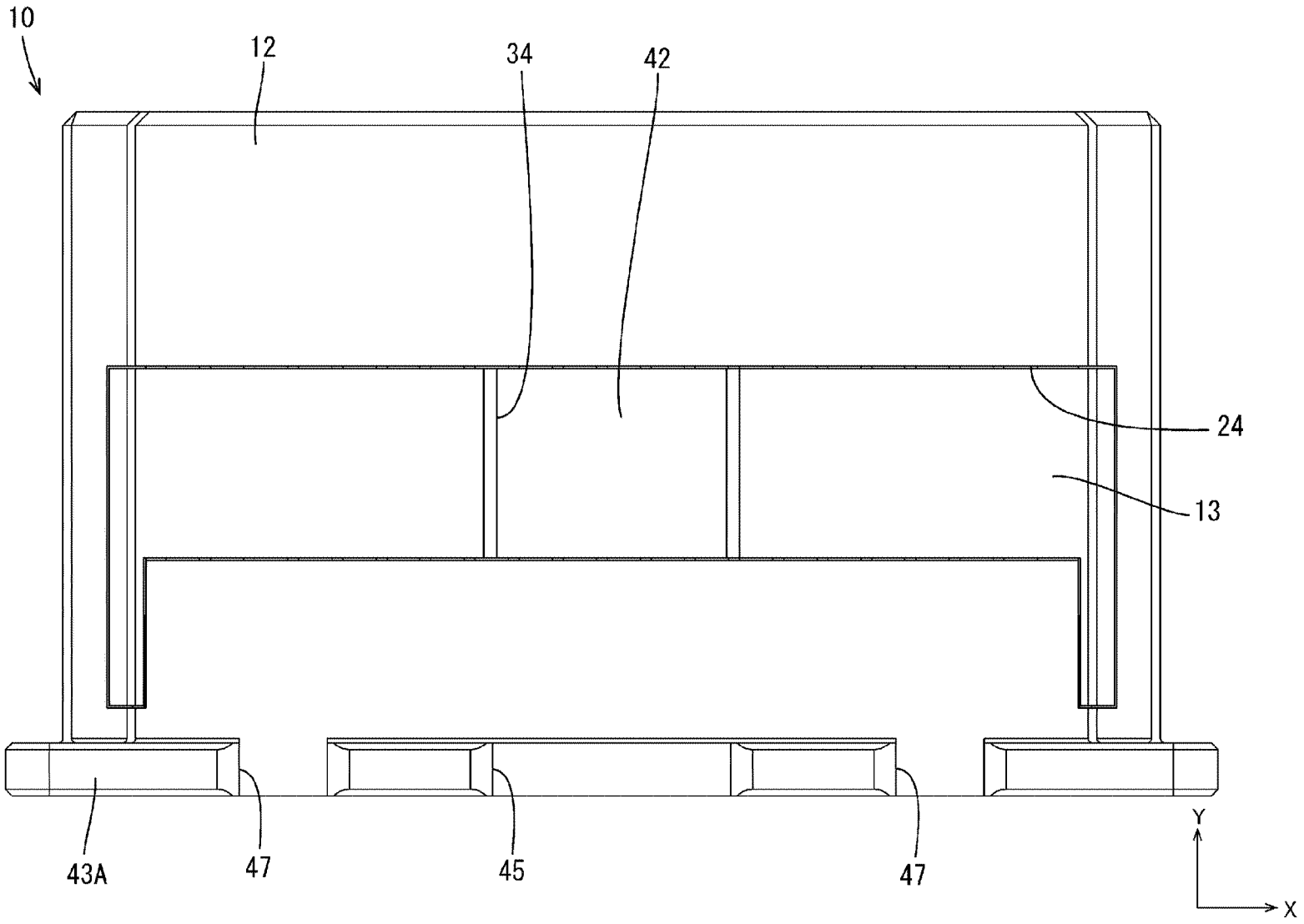
FIG. 4 is a bottom view showing the connector in which the retainer is mounted at the full locking position.

As shown in FIG. 4, the connector housing 12 is provided with a retainer accommodation recess 24 which is open downward and into which the retainer 13 is mounted from below. The retainer accommodation recess 24 communicates with the cavities 14.

Figure 7:
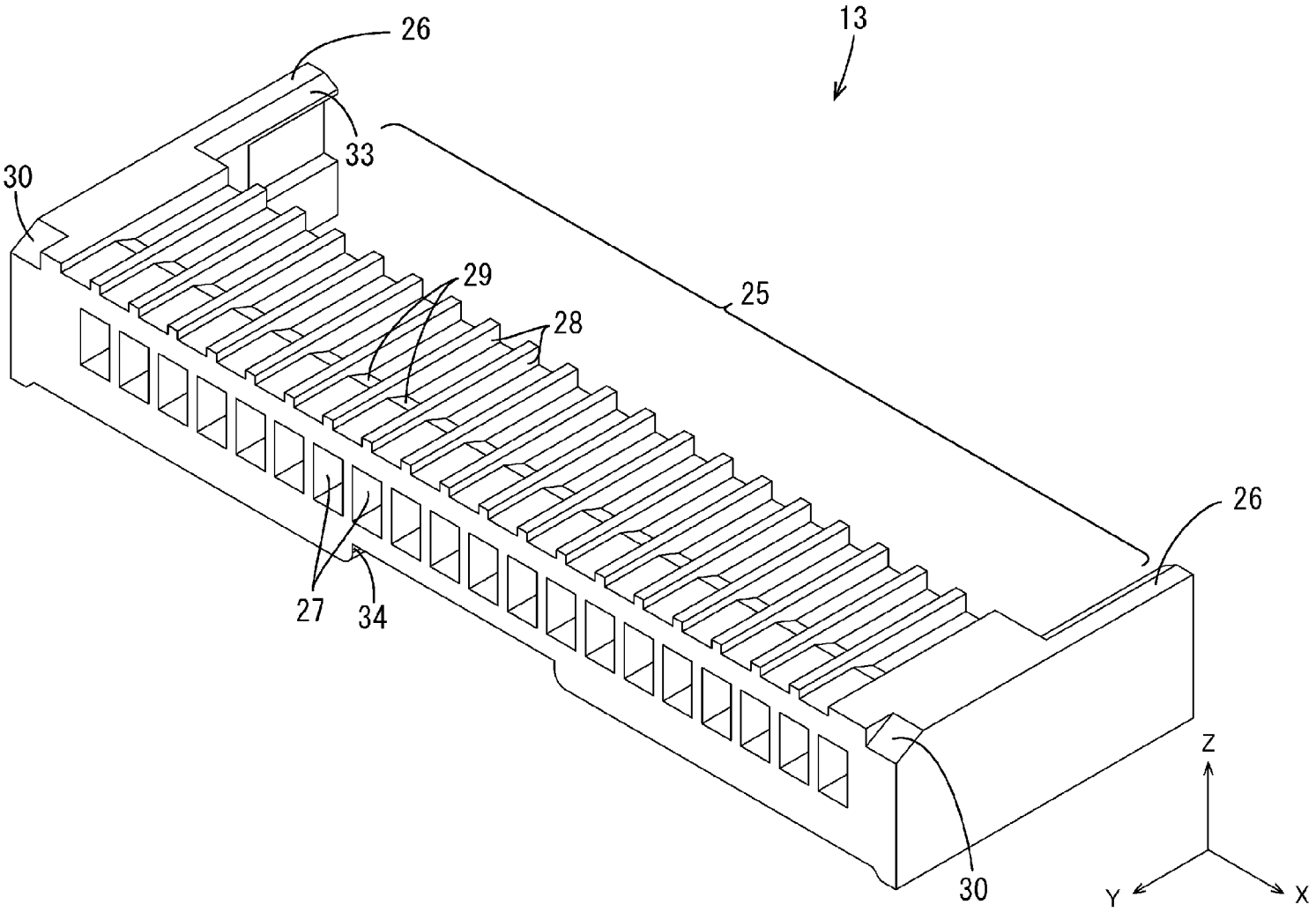
FIG. 7 is a perspective view showing the retainer.
Figure 8:
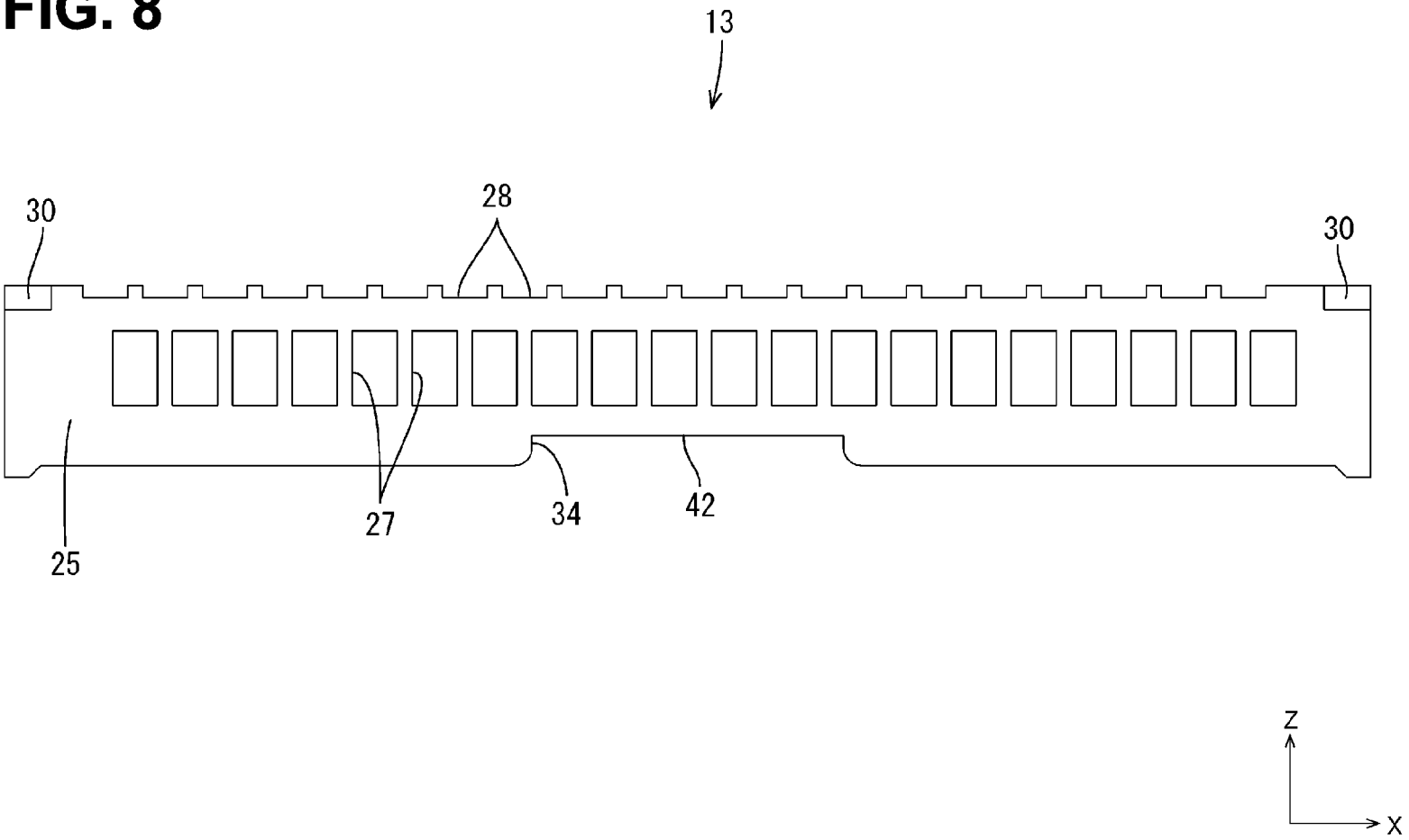
FIG. 8 is a front view showing the retainer.
Figure 9:
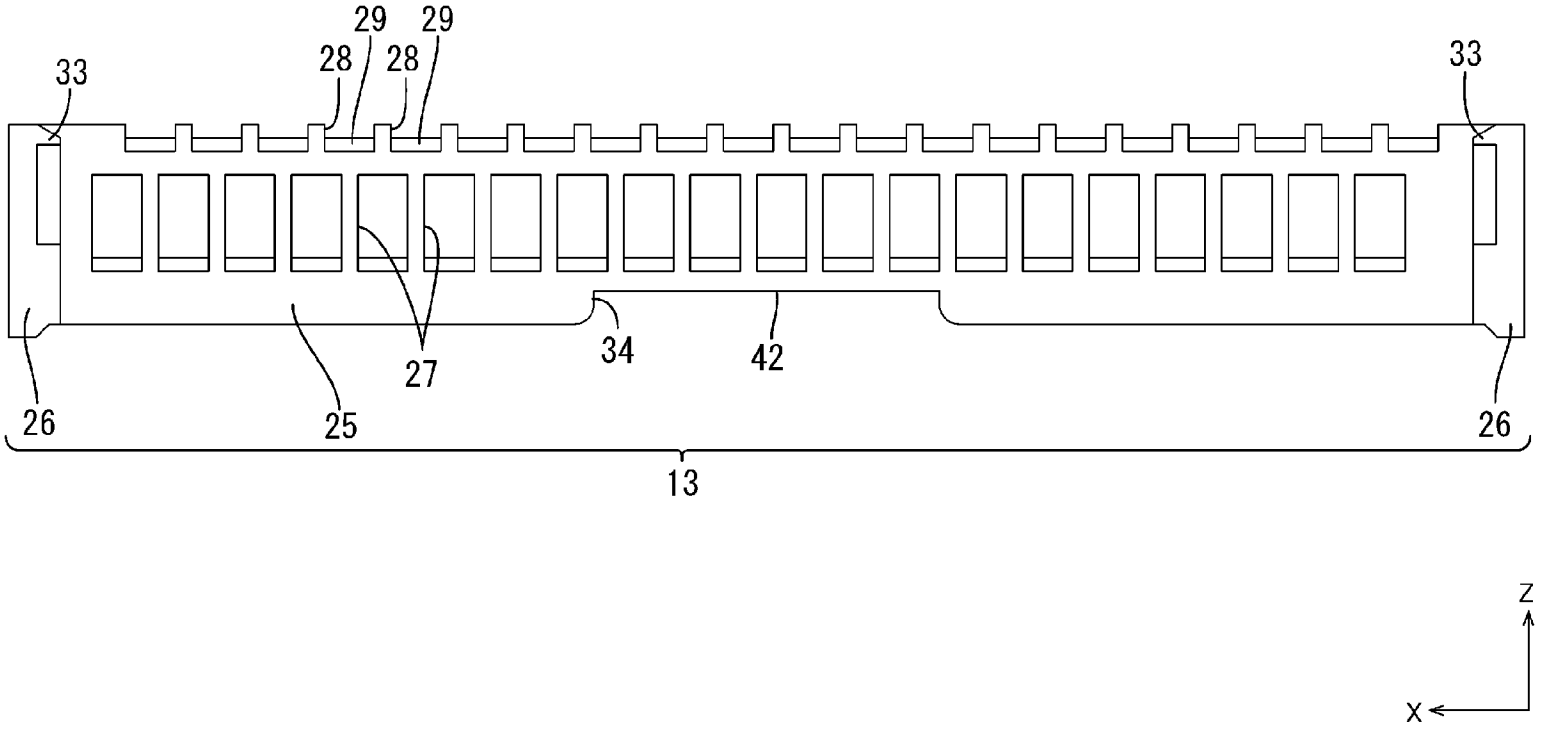
FIG. 9 is a back view showing the retainer.

As shown in FIGS. 7 to 9, the retainer 13 includes a retainer body 25 made of insulating synthetic resin and elongated in the lateral direction, and two extending portions 26 extending rearward from both left and right end parts of the retainer body 25. The retainer body 25 is formed with a plurality of retainer-side cavities 27 extending in the front-rear direction and arranged at intervals in the lateral direction. The retainer-side cavities 27 penetrate through the retainer body 25 in the front-rear direction. The retainer-side cavities 27 have a substantially rectangular cross-sectional shape when viewed from the front-rear direction.

A plurality of groove portions 28 extending in the front-rear direction are arranged in the lateral direction and formed by being recessed downwardly in the upper surface of the retainer body 25. The groove portions 28 have a substantially U-shaped cross-sectional shape. The groove portions 28 are provided at positions corresponding to the respective cavities 14 in the upper stage provided in the connector housing 12 with the retainer 13 mounted in the retainer accommodation recess 24 of the connector housing 12. A substantially one-third area of the bottom surface of the groove portion 28 in the front-rear direction from a front end is formed to be higher than a substantially two-third area thereof from a rear end. An inclined surface 29 inclined with respect to the front-rear direction is formed between the substantially one-third area from the front end and the substantially two-third area from the rear end described above.

Both left and right corner parts of an upper edge part of a front end part of the retainer body 25 are chamfered to form first contact portions 30 inclined with respect to the front-rear direction. These first contact portions 30 are formed into a forward inclined shape. First protrusions 32 of a jig 31 to be described later come into contact with these first contact portions 30 from front.

A vertical height of the extending portions 26 is set equal to a height of the retainer body 25. A rearward projecting dimension of the extending portions 26 is set somewhat smaller than a length in the front-rear direction of the retainer body 25. The extending portions 26 are in the form of plates having a relatively small thickness in the lateral direction.

A lock receiving portion 33 projecting laterally inward is formed on the upper end edge of the extending portion 26. The upper surface of the lock receiving portion 33 is formed to be inclined downward toward an inner side in the lateral direction. An upper end of the extending portion 26 is formed to have a smaller thickness in the lateral direction than a lower part. In this way, the upper part of the extending portion 26 is resiliently deformable in the lateral direction.

The lower surface of the retainer 13 is recessed near a laterally central position, thereby forming a guide rib avoiding recess 34 located higher than other parts of this lower surface. The guide rib avoiding recess 34 is formed to extend in the front-rear direction.

A lock arm 35 extending rearward from a front end part of the connector housing 12 is resiliently deformably formed on the upper surface of the connector housing 12. A lock portion 36 to be engaged with an unillustrated mating connector is formed to project upward on the upper surface of the lock arm 35. A grip portion 37 on which a worker places his/her finger is formed to extend in the lateral direction on a rear end part of the lock arm 35. A protection rib 38 is formed to project upward to surround left, right and front sides of the grip portion 37 at a position near a rear end part on the upper surface of the connector housing 12. As shown in FIG. 1, a projecting height of the protection rib 38 from the upper surface of the connector housing 12 is set higher than that of the grip portion 37 of the lock arm 35.

Receiving hole portions 39 (an example of a receiving recess) open forward are formed at positions near both left and right end parts in the front end part of the connector housing 12. The receiving hole portions 39 have a substantially rectangular cross-sectional shape. The first protrusions 32 provided in the jig 31 to be described later are inserted into the receiving hole portions 39 from front. The receiving hole portions 39 communicate with the retainer accommodation recess 24. As shown in FIG. 2, the above first contact portions 30 are facing the receiving hole portions 39 with the retainer 13 held at the full locking position with respect to the connector housing 12.

Figure 10:
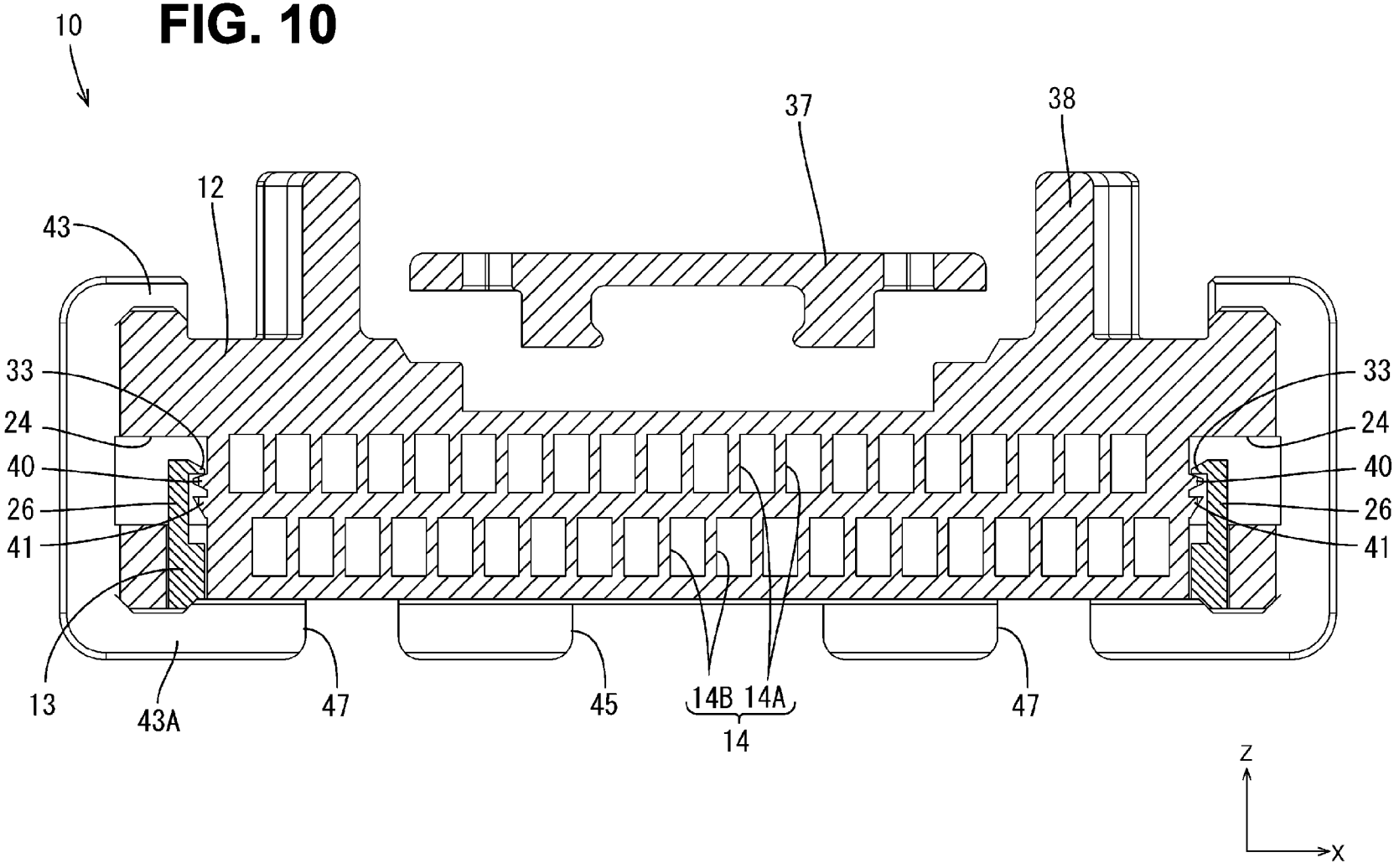
FIG. 10 is a section showing a state where lock receiving portions of the retainer are locked to full locking portions of a connector housing.
Figure 11:
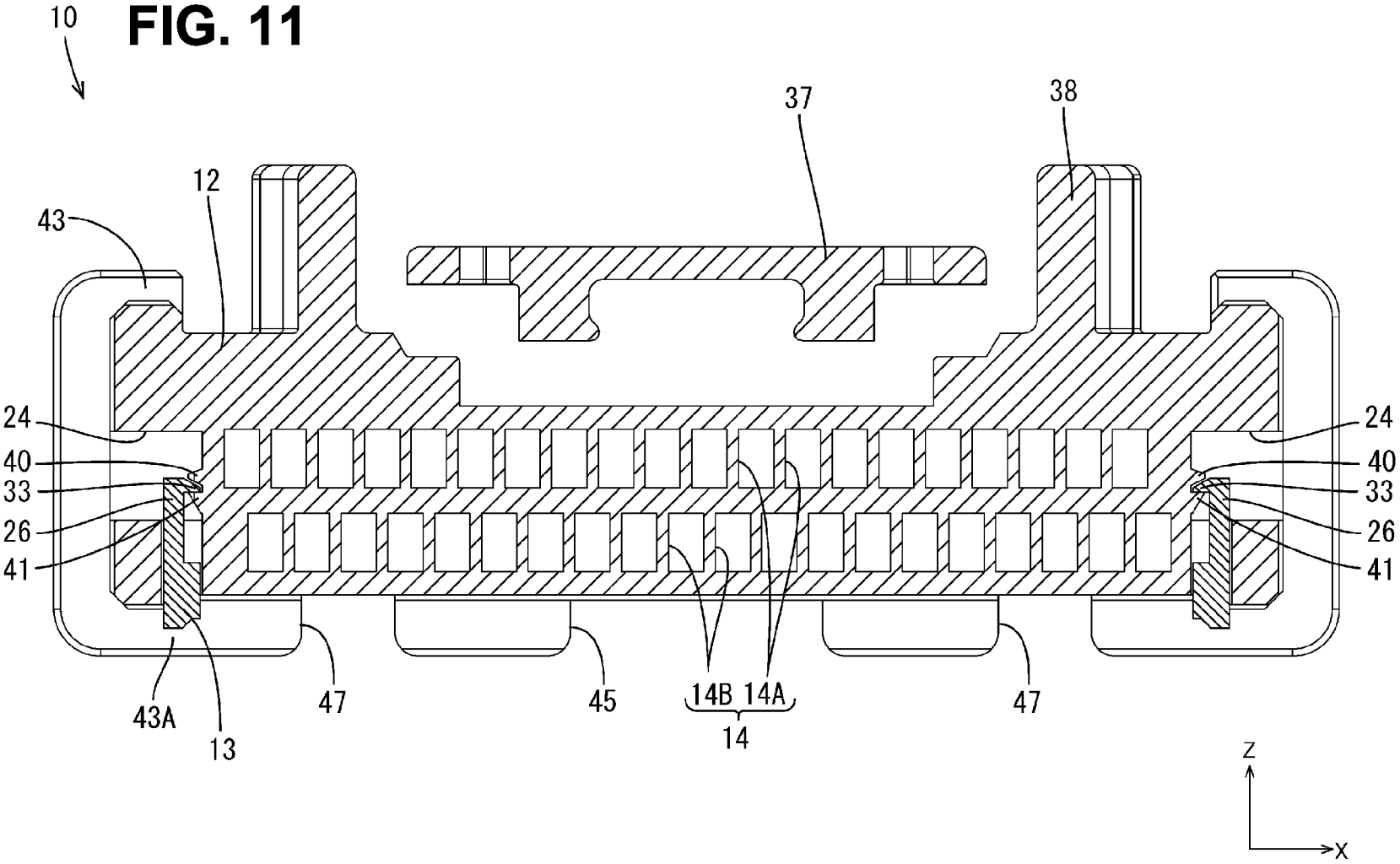
FIG. 11 is a section showing a state where the lock receiving portions of the retainer are locked to partial locking portions of the connector housing.
Figure 12:
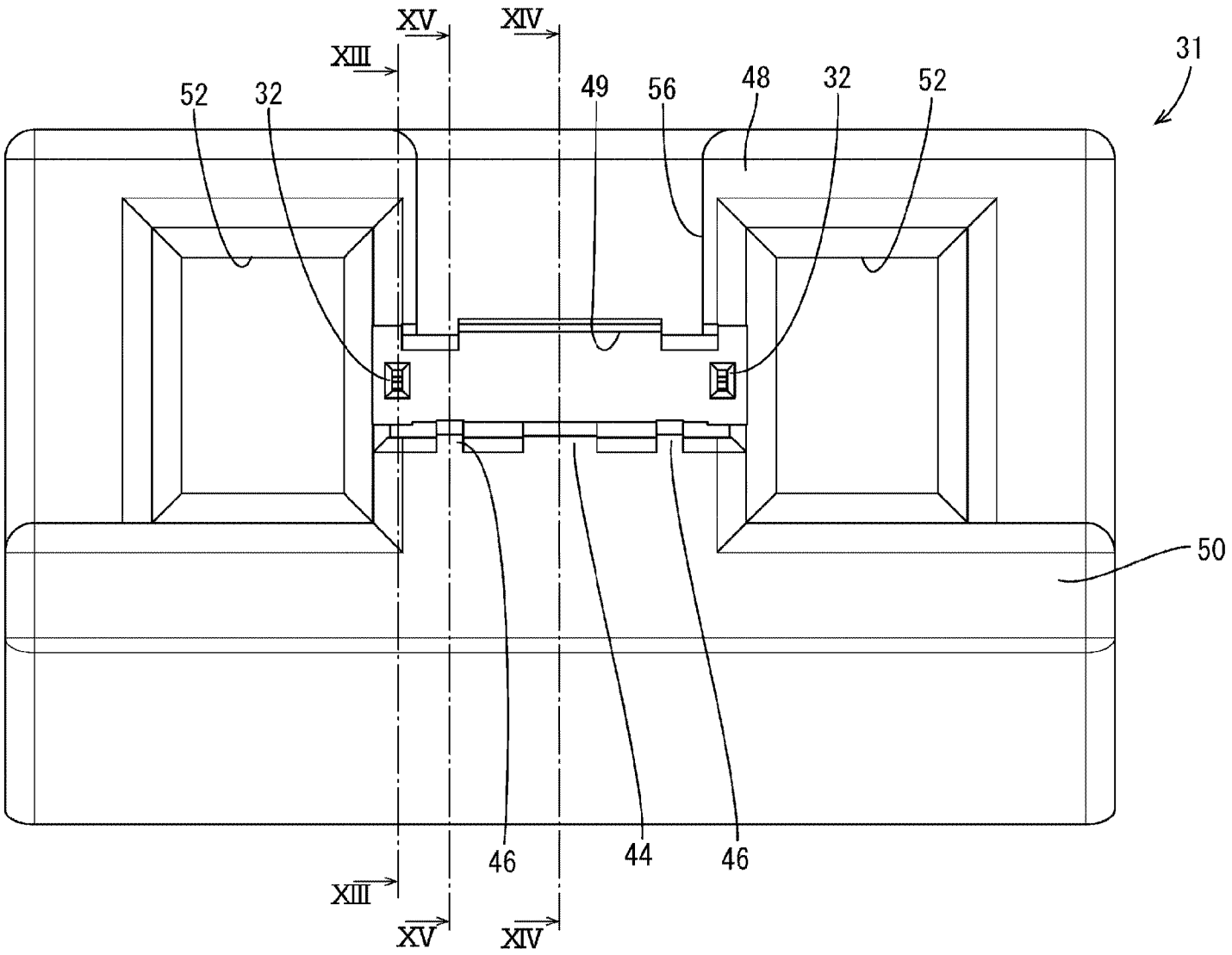
FIG. 12 is a front view showing a jig.
Figure 13:
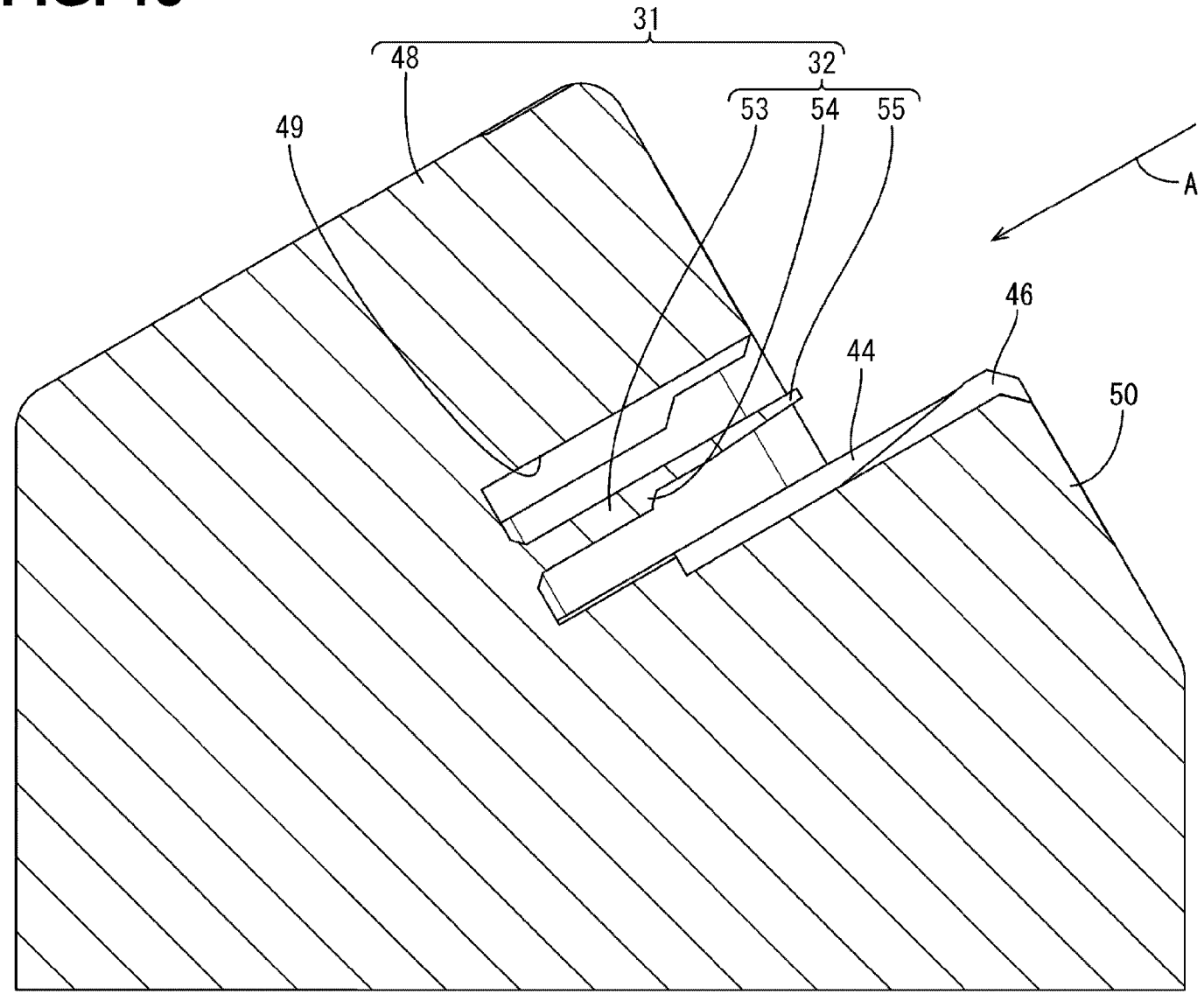
FIG. 13 is a section showing a first protrusion of the jig.
Figure 14:
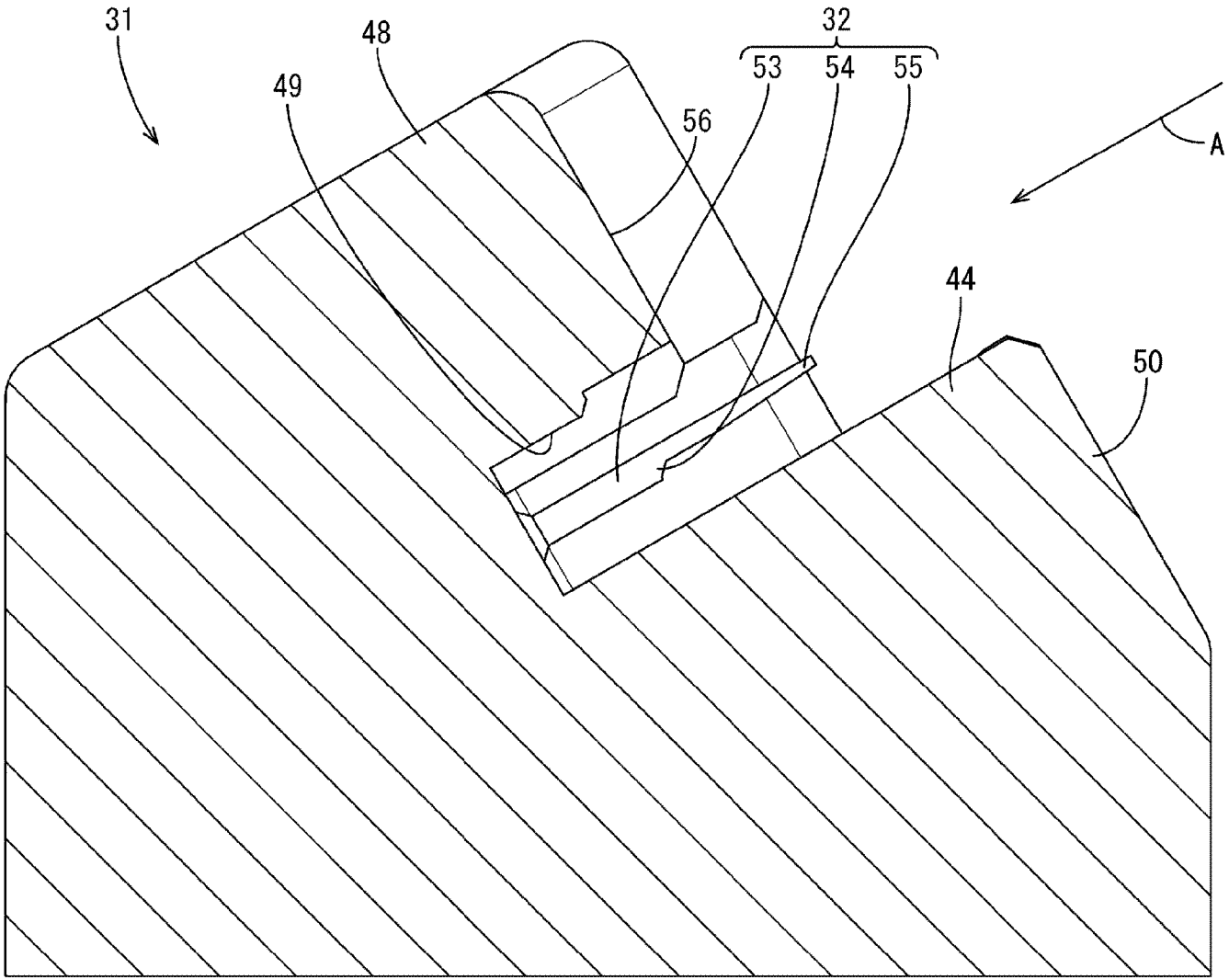
FIG. 14 is a section showing a guide rib of the jig.
Figure 15:
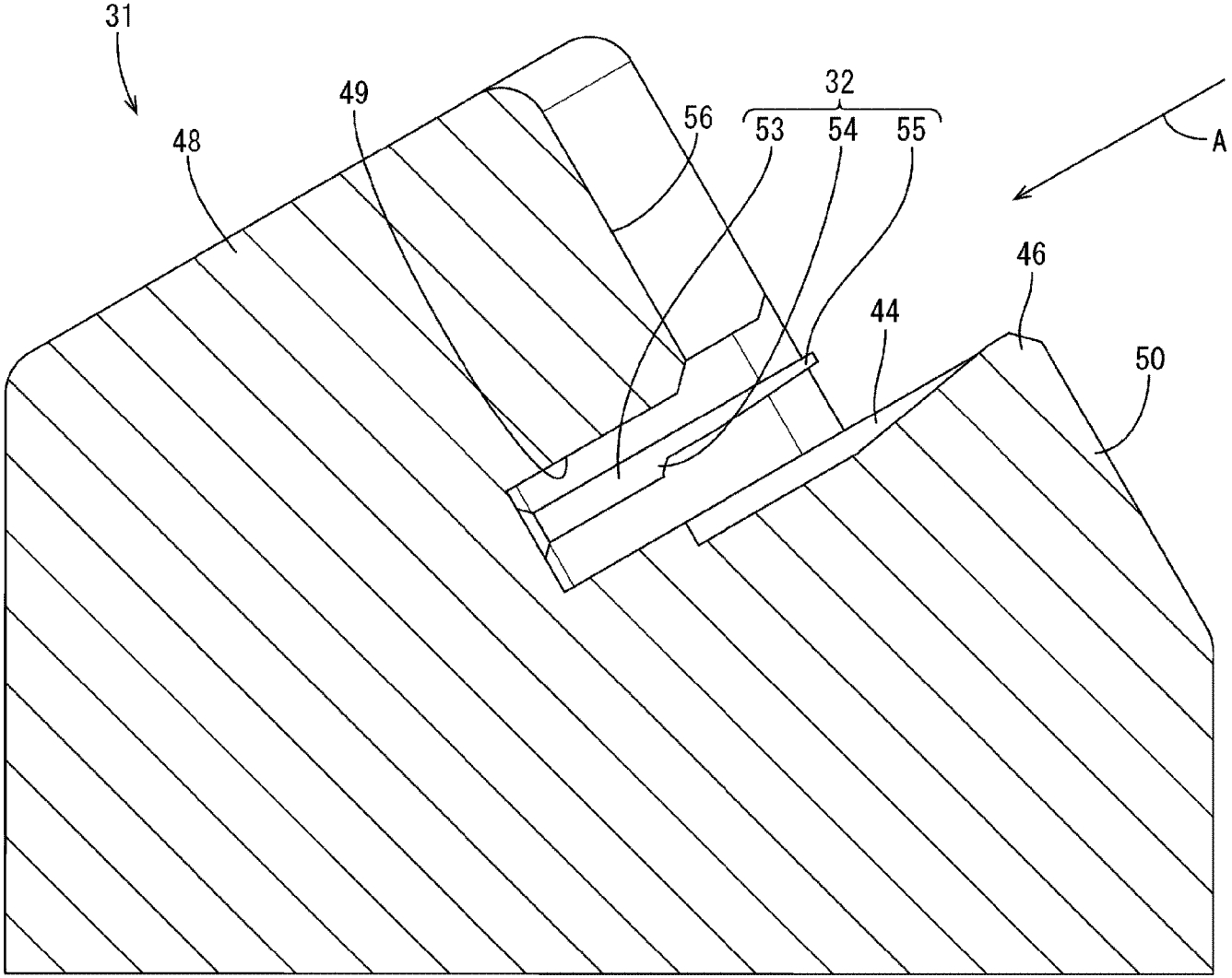
FIG. 15 is a section showing shows a second protrusion of the jig.

As shown in FIGS. 10 and 11, full locking portions 40 projecting laterally outward and partial locking portions 41 located below the full locking portions 40 and projecting laterally outward are provided on inner wall surfaces of the retainer accommodation recess 24.

As shown in FIG. 10, the lock receiving portions 33 of the retainer 13 are resiliently locked to the full locking portions 40 of the connector housing 12 with the retainer 13 mounted in the retainer accommodation recess 24 of the connector housing 12, whereby the retainer 13 is held at the full locking position with respect to the connector housing 12.

With the retainer 13 held at the full locking position with respect to the connector housing 12, the retainer 13 projects into the respective cavities 14A, 14B in the upper and lower stages. In this state, the retainer 13 is in contact with rear end parts of the connecting tube portions 18 of the female terminals 11 accommodated in the respective cavities 14A, 14B, whereby the female terminals 11 are prevented from coming out rearward.

As shown in FIG. 11, the lock receiving portions 33 of the retainer 13 are resiliently locked to the partial locking portions 41 of the connector housing 12 with the retainer 13 mounted in the retainer accommodation recess 24 of the connector housing 12, whereby the retainer 13 is held at the partial locking position with respect to the connector housing 12.

With the retainer 13 held at the partial locking position with respect to the connector housing 12, the retainer 13 is retracted from the respective cavities 14A, 14B in the upper and lower stages. In this way, the female terminals 11 can be inserted into the respective cavities 14A, 14B through the terminal insertion holes 17 with the retainer 13 held at the partial locking position with respect to the connector housing 12.

Figure 3:
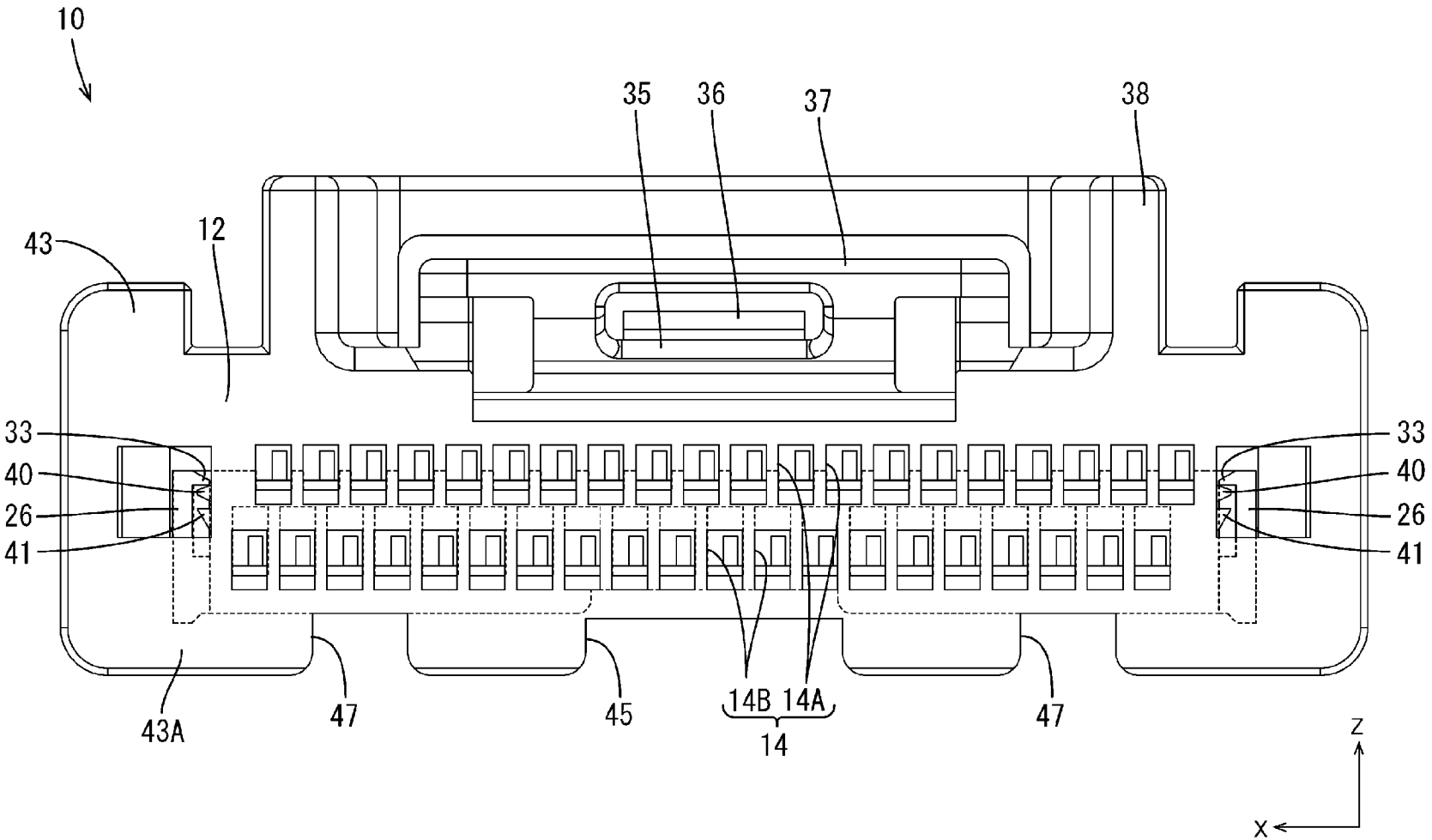
FIG. 3 is a back view showing the connector in which the retainer is mounted at the full locking position.

As shown in FIGS. 2 and 3, with the retainer 13 held at the full locking position with respect to the connector housing 12, the lower surface of the retainer 13 is located above that of the connector housing 12 or set to be flush with that of the connector housing 12. In other words, with the retainer 13 held at the full locking position with respect to the connector housing 12, the lower surface of the retainer 13 does not project downward from the lower surface of the connector housing 12.

Figure 5:
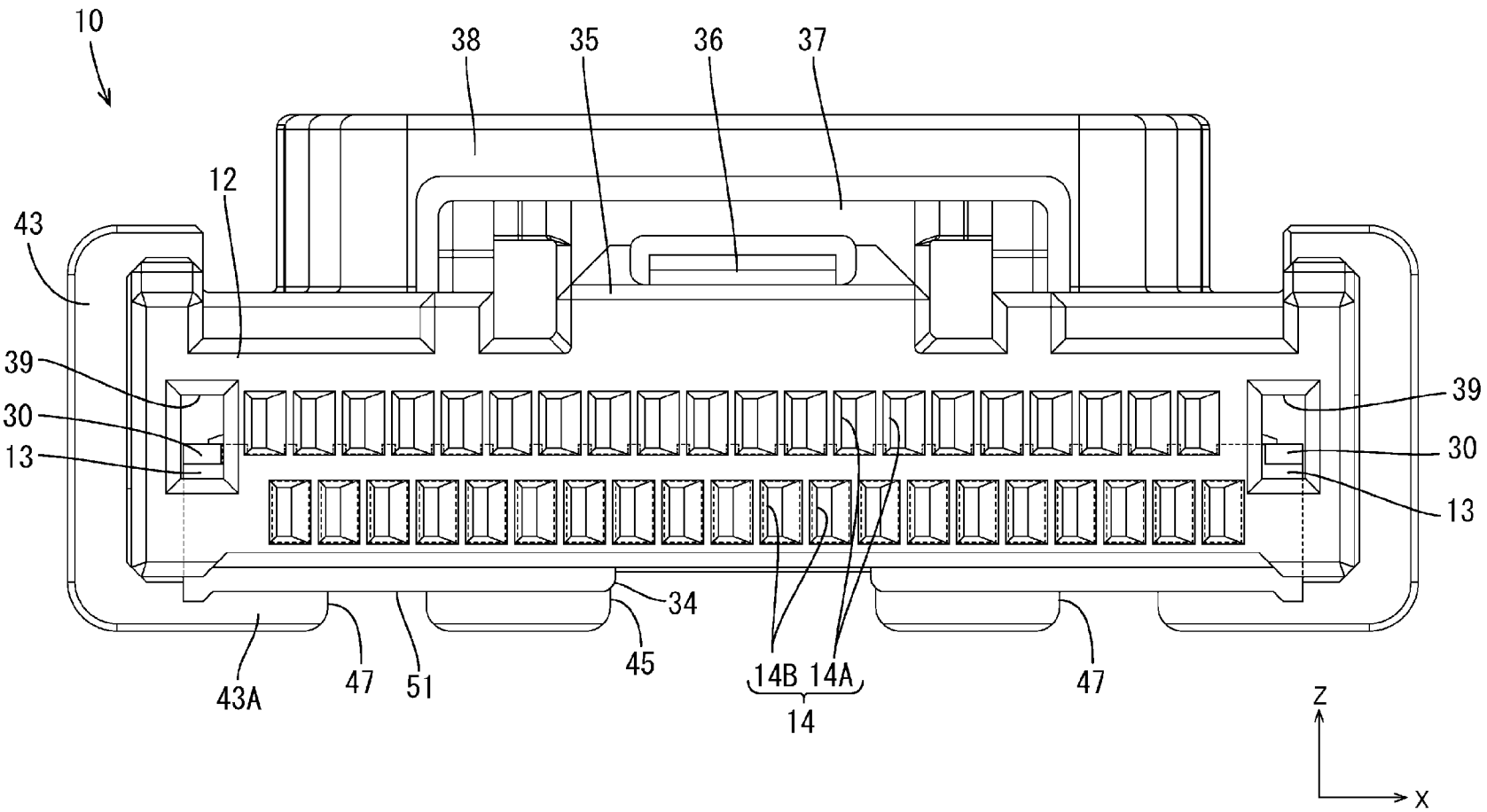
FIG. 5 is a front view showing the connector in which the retainer is mounted at a partial locking position.
Figure 6:
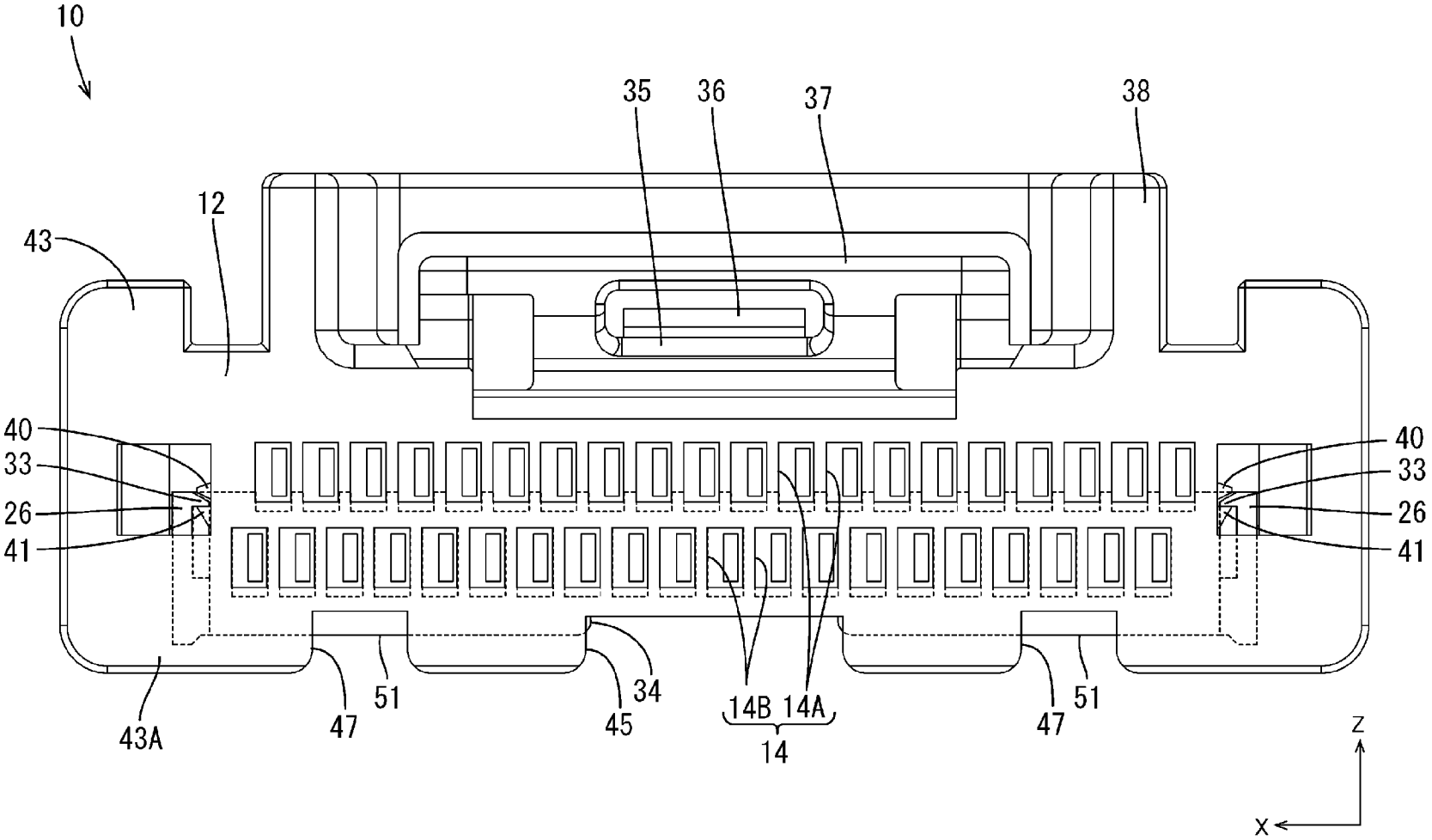
FIG. 6 is a back view showing the connector in which the retainer is mounted at the partial locking position.

As shown in FIGS. 5 and 6, with the retainer 13 held at the partial locking position with respect to the connector housing 12, parts of the lower surface of the retainer 13 different from the guide rib avoiding recess 34 project further downward than the lower surface of the connector housing 12. In this state, a bottom surface 42 of the guide rib avoiding recess 34 is set to be flush with the lower surface of the connector housing 12 or located above the lower surface of the connector housing 12. In this embodiment, the bottom surface 42 of the guide rib avoiding recess 34 is set to be flush with the lower surface of the connector housing 12 with the retainer 13 held at the partial locking position with respect to the connector housing 12.

An end rib 43 projecting in a direction intersecting the front-rear direction is provided on the rear end part of the connector housing 12. The end rib 43 is provided on a left-rear end part, a right-rear end part and a lower end part of the connector housing 12. Further, the end rib 43 is provided on both left and right end parts of an upper-rear end part of the connector housing 12.

Out of the end rib 43, a lower end rib 43A provided on the lower surface of the connector housing 12 is recessed upwardly near a lateral center to form a guide groove 45 to be engaged with a guide rib 44 of the jig 31 to be described later.

The end rib 43 is recessed upwardly at positions somewhat inward of both left and right end parts to form second protrusion avoiding recesses 47 for avoiding interference with second protrusions 46 provided on the jig 31 to be described later.

(Jig 31)

As shown in FIGS. 12 to 15, the jig 31 includes a jig body 48 made of insulating synthetic resin and the first protrusions 32 embedded in the jig body 48.

The jig body 48 includes a connector accommodation recess 49 having a substantially rectangular opening. The connector housing 12 assembled with the retainer 13 is inserted into the connector accommodation recess 49 along an inserting direction A. The connector accommodation recess 49 is formed to extend along the inserting direction A.

A protection rib avoiding recess 56 for avoiding interference with the protection rib 38 of the connector housing 12 is provided above the connector accommodation recess 49 by being recessed forwardly with respect to the inserting direction A.

A projecting base portion 50 projecting rearward with respect to the inserting direction A is formed at a position below the connector accommodation recess 49 on the front surface of the jig body 48. The upper surface of the projecting base portion 50 is continuous with the bottom surface of the connector accommodation recess 49. The second protrusions 46 projecting upward are formed at positions near lateral end parts on the upper surface of the projecting base portion 50. The second protrusions 46 are provided on a rear end part of the projecting base portion 50. The upper surface of the second protrusion 46 is inclined downwardly toward the front with respect to the inserting direction A. Parts of the lower surface of the retainer 13 to be brought into contact with the second protrusions 46 serve as second contact portions 51.

The guide rib 44 projecting upward and extending in the front-rear direction along the inserting direction A is provided near a lateral center of the upper surface of the projecting base portion 50.

The front surface of the jig body 48 is recessed at positions laterally outward of the connector accommodation recess 49 to form work recesses 52. In inserting the connector housing 12 having the retainer 13 mounted therein into the connector accommodation recess 49, the worker can more easily grip the connector housing 12 using these work recesses 52. The work recesses 52 are formed to have a rectangular shape when viewed from behind.

The first protrusions 32 projecting rearward with respect to the inserting direction A are respectively provided at positions near both lateral end parts on a front wall of the connector accommodation recess 49 located on a front side in the inserting direction A. The first protrusions 32 are made of metal and integrally formed to the jig body 48. Front end parts of the first protrusions 32 in the inserting direction A are embedded in the jig body 48.

The first protrusion 32 is in the form of a tab extending along the inserting direction A. The first protrusion 32 includes a base portion 53 extending rearward with respect to the inserting direction A from the front wall of the connector accommodation recess 49, an inclined portion 54 connected to the base portion 53 and having a lower surface inclined upwardly toward a rear side in the inserting direction A, and a tip portion 55 connected to the inclined portion 54 and extending rearward with respect to the inserting direction A. The tip portion 55 of the first protrusion 32 projects slightly further rearward with respect to the inserting direction A than the front surface of the jig body 48.

(Example of Method for Manufacturing Connector 10)

Next, an example of a method for manufacturing the connector 10 is described. Note that the method for manufacturing the connector 10 is not limited to the one described below.

The metal plate material is press-worked to form the female terminal 1 having a predetermined shape. The insulation coating 23 on an end part of the wire 21 is stripped to expose the core 22. The wire barrel 19 is crimped to the core 22, and the insulation barrel 20 is crimped to the insulation coating 23.

The connector housing 12 and the retainer 13 are formed by injection-molding synthetic resin. The retainer 13 is mounted into the retainer accommodation recess 24 of the connector housing 12 from below. In this way, the retainer 13 is fit in the retainer accommodation recess 24. The lock receiving portions 33 of the retainer 13 are resiliently engaged with the full locking portions 40 of the connector housing 12. In this way, the retainer 13 is held at the full locking position with respect to the connector housing 12.

The jig 31 is formed into a predetermined shape by insert molding synthetic resin together with the first protrusions 32 made of metal.

Figure 16:
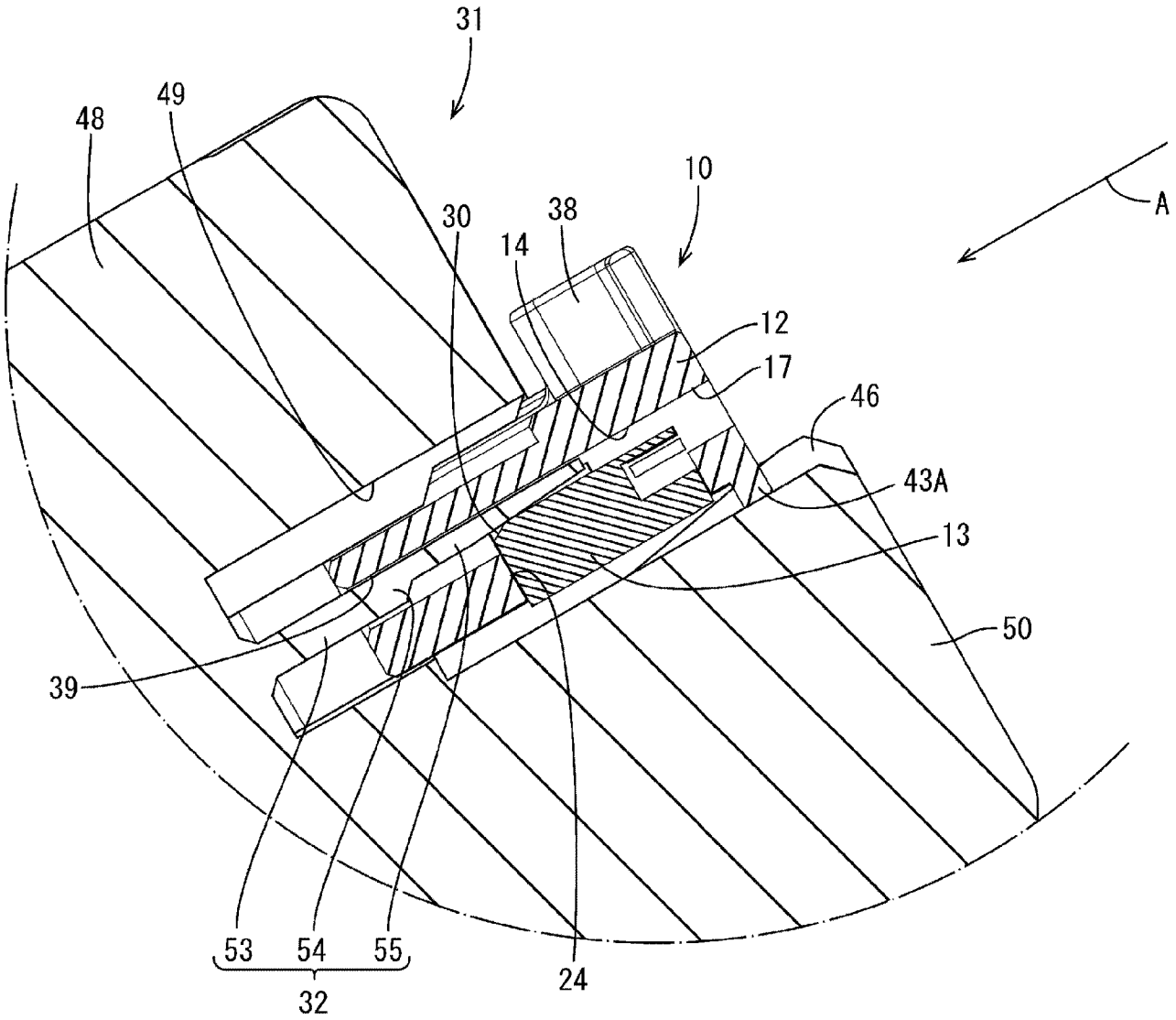
FIG. 16 is a section showing a process of inserting the connector housing having the retainer mounted at the full locking position into a connector accommodation recess.
Figure 17:
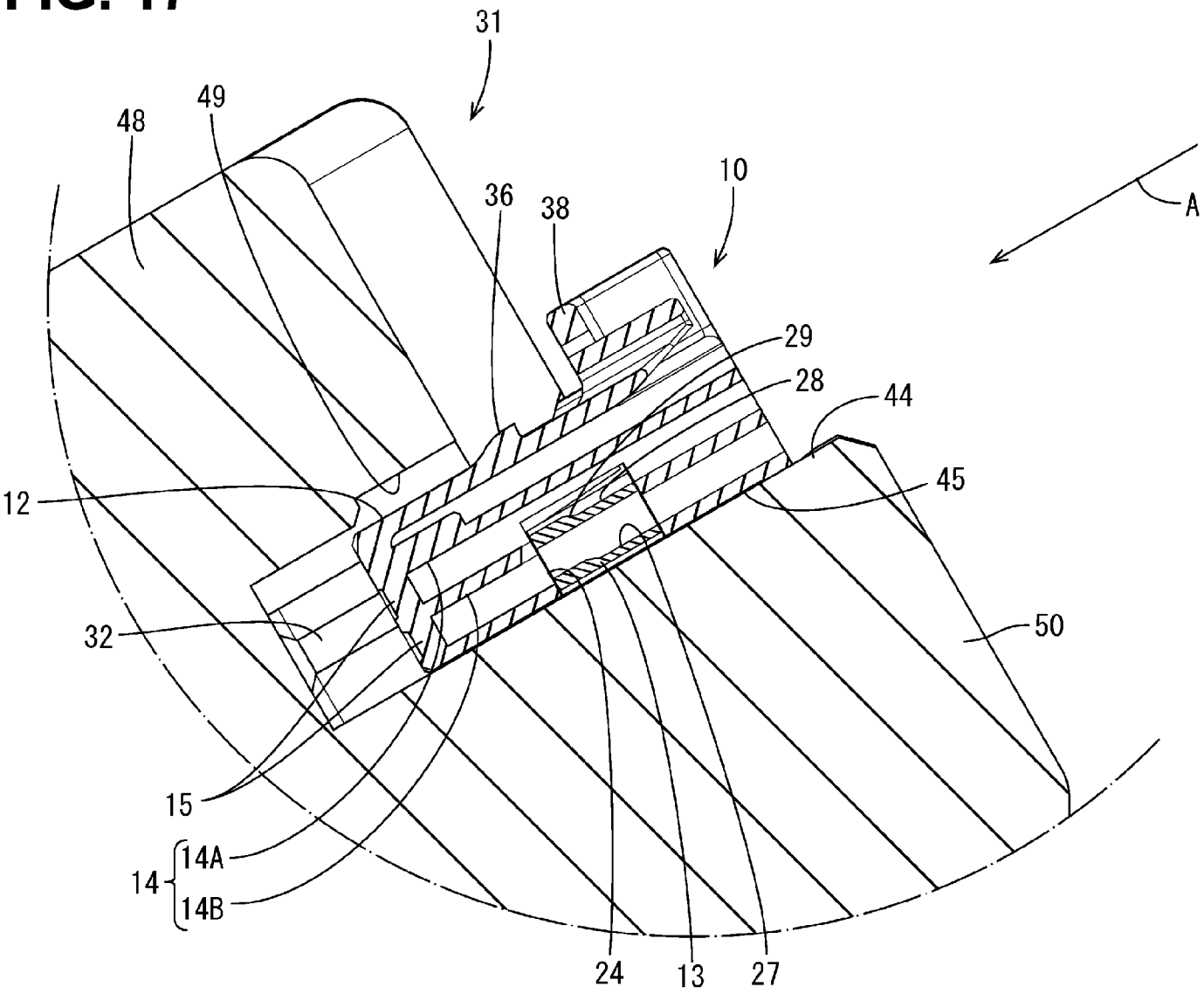
FIG. 17 is a section, showing a cross-section different from that of FIG. 16, in the process of inserting the connector housing having the retainer mounted at the full locking position into the connector accommodation recess.
Figure 18:
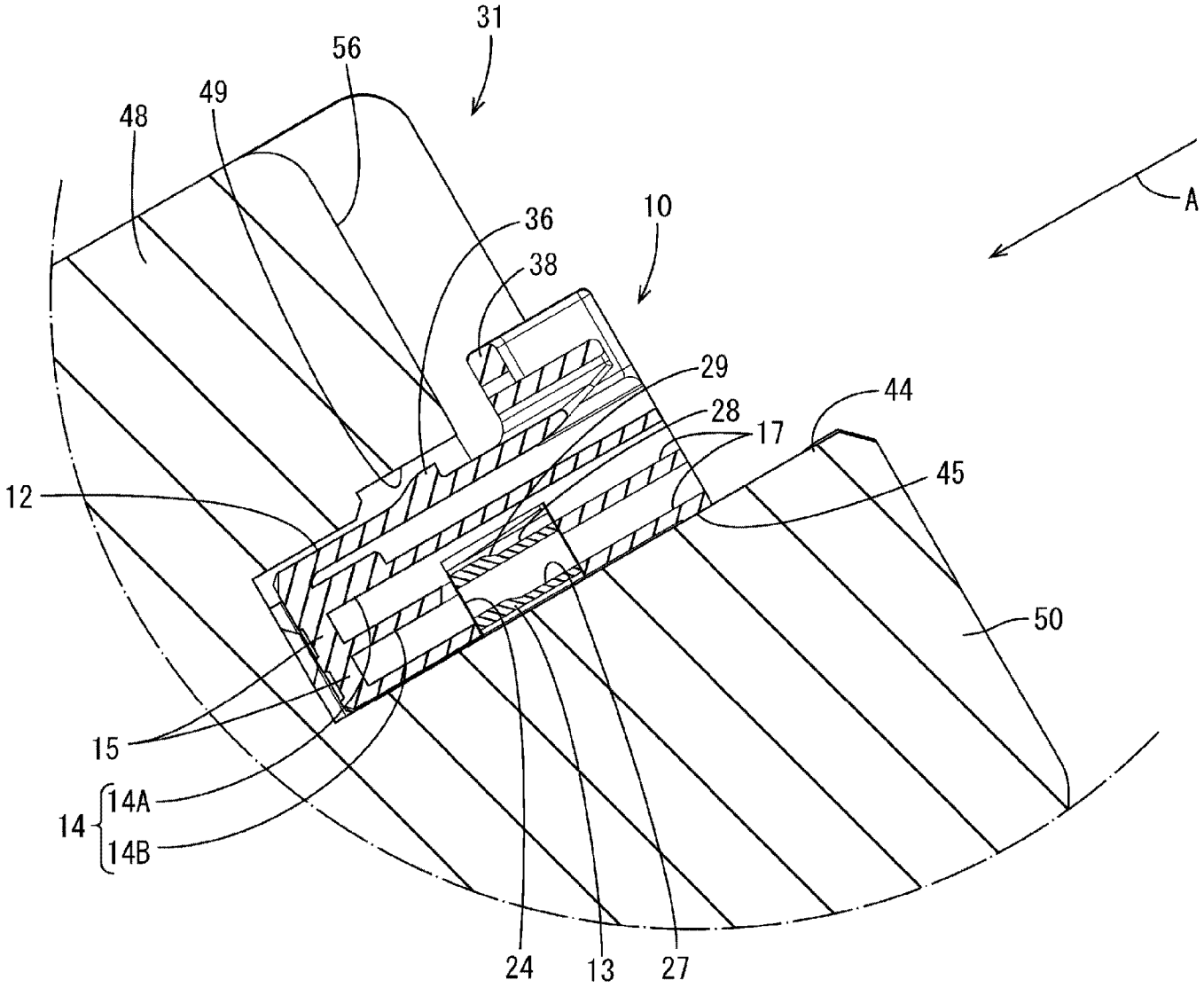
FIG. 18 is a section showing a state where the connector housing is accommodated in the connector accommodation recess and the retainer is at the partial locking position.

As shown in FIGS. 16 and 17, the connector housing 12 having the retainer 13 mounted at the full locking position is inserted into the connector accommodation recess 49 of the jig 31 from behind with respect to the inserting direction A. At this time, the upper surface of the projecting base portion 50 and the lower surface of the connector housing 12 are caused to slide in contact with each other, whereby the connector housing 12 is guided into the connector accommodation recess 49. Further, the guide groove 45 of the end rib 43 is engaged with the guide rib 44 of the jig 31, whereby the connector housing 12 moves along the inserting direction A in the connector accommodation recess 49.

If the connector 12 is pushed forward with respect to the inserting direction A, the tip portions 55 of the first protrusions 32 are inserted into the receiving hole portions 39 of the connector housing 12 from front with respect to the inserting direction A. If the connector housing 12 is pushed further forward, the tip portions 55 of the first protrusions 32 slide in contact with the upper surface of the retainer 13.

If the connector housing 12 is pushed further forward, the lower surfaces of the inclined portions 54 of the first protrusions 32 come into contact with the first contact portions 30 of the retainer 13 from front with respect to the inserting direction A. Then, the lower surfaces of the inclined portions 54 of the first protrusions 32 press the first contact portions 30 of the retainer 13 downwardly. By pressing the retainer 13 downwardly, the lock receiving portions 33 of the retainer 13 are resiliently deformed and ride on the full locking portions 40 of the connector housing 12.

If the connector housing 12 is pushed further forward, the retainer 13 moves further downward and the lock receiving portions 33 of the retainer 13 are restored and resiliently locked to the partial locking portions 41 of the connector housing 12. In this way, the retainer 13 is held at the partial locking position with respect to the connector housing 12 (see FIG. 18).

Since the bottom surface 42 of the guide rib avoiding recess 34 of the retainer 13 is flush with the lower surface of the connector housing 12 with the retainer 13 held at the partial locking position, the interference of the retainer 13 and the guide rib 44 is avoided. Further, in this state, the second contact portions 51 of the retainer 13 project downward from the lower surface of the connector housing 12.

The connector housing 12 is positioned in the vertical direction with respect to the jig 31 by being sandwiched between the bottom surface and the ceiling surface of the connector accommodation recess 49. Further, the connector housing 12 is positioned in the lateral direction with respect to the jig 31 by the engagement of the guide rib 44 and the guide groove 45.

Figure 20:
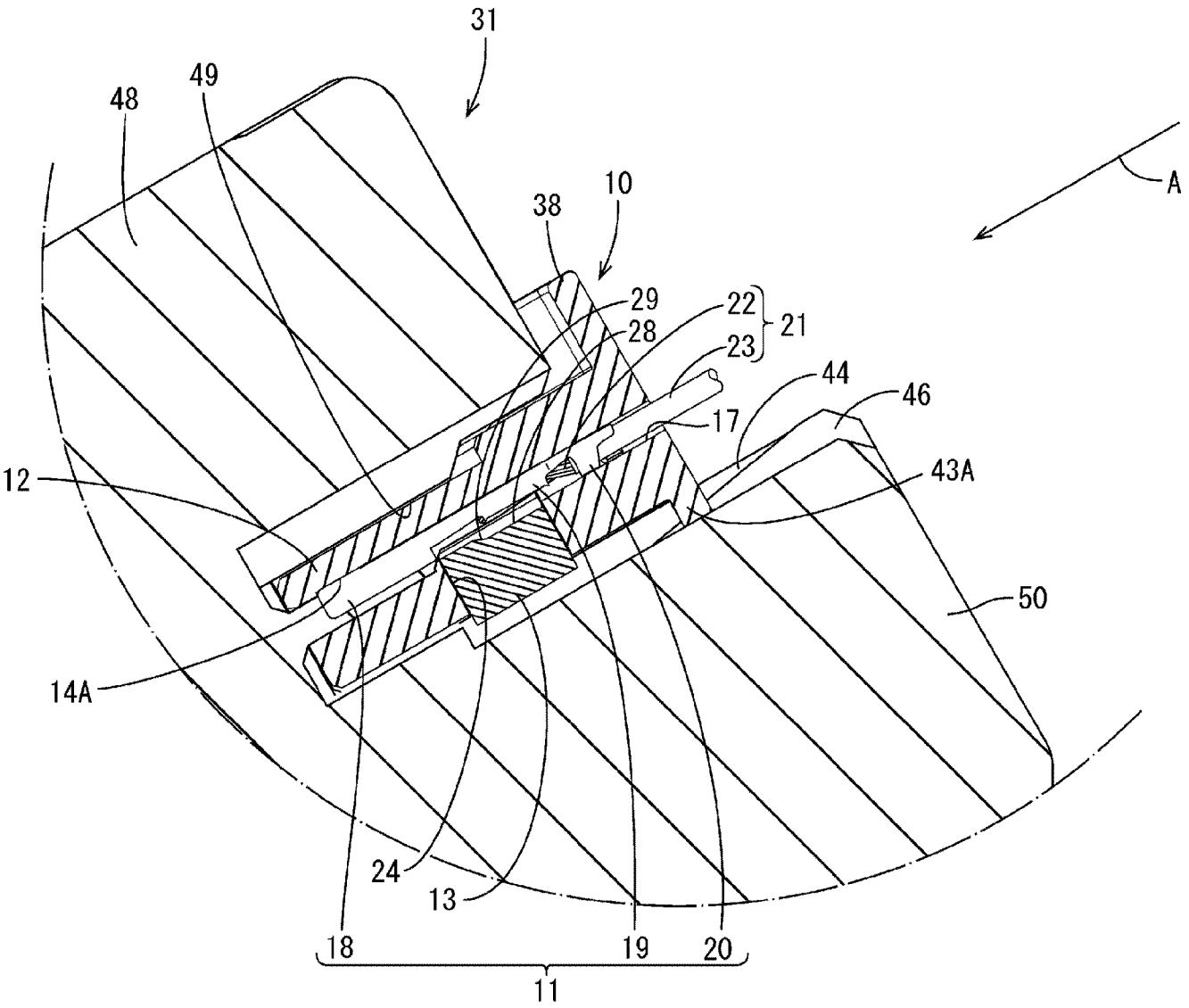
FIG. 20 is a section, showing a cross-section different from that of FIG. 19, in the state where the female terminal is inserted in the connector housing.

Subsequently, as shown in FIGS. 19 and 20, the female terminal 11 is inserted into the cavity 14 of the connector housing 12 from behind with respect to the inserting direction A of the connector housing 12. Since the retainer 13 is retracted from the cavities 14 of the connector housing 12 with the retainer 13 held at the partial locking position, the retainer 13 does not interfere with the female terminal 11. The female terminal 11 is pushed until a front end part of the connecting tube portion 18 of the female terminal 11 comes into contact with the front wall 15 of the cavity 14. In this way, the female terminal 11 is disposed at a proper position with respect to the connector housing 12.

After the female terminals 11 are inserted into the cavities 14, the worker inserts his/her fingers into the work recesses 52 and grips the end rib 43 of the connector housing 12 from left and right sides. Subsequently, the connector housing 12 is pulled rearwardly. Then, the guide rib 44 of the jig 31 and the guide groove 45 of the connector housing 12 slide in contact with each other, whereby the connector housing 12 moves rearward along the inserting direction A.

Figure 21:
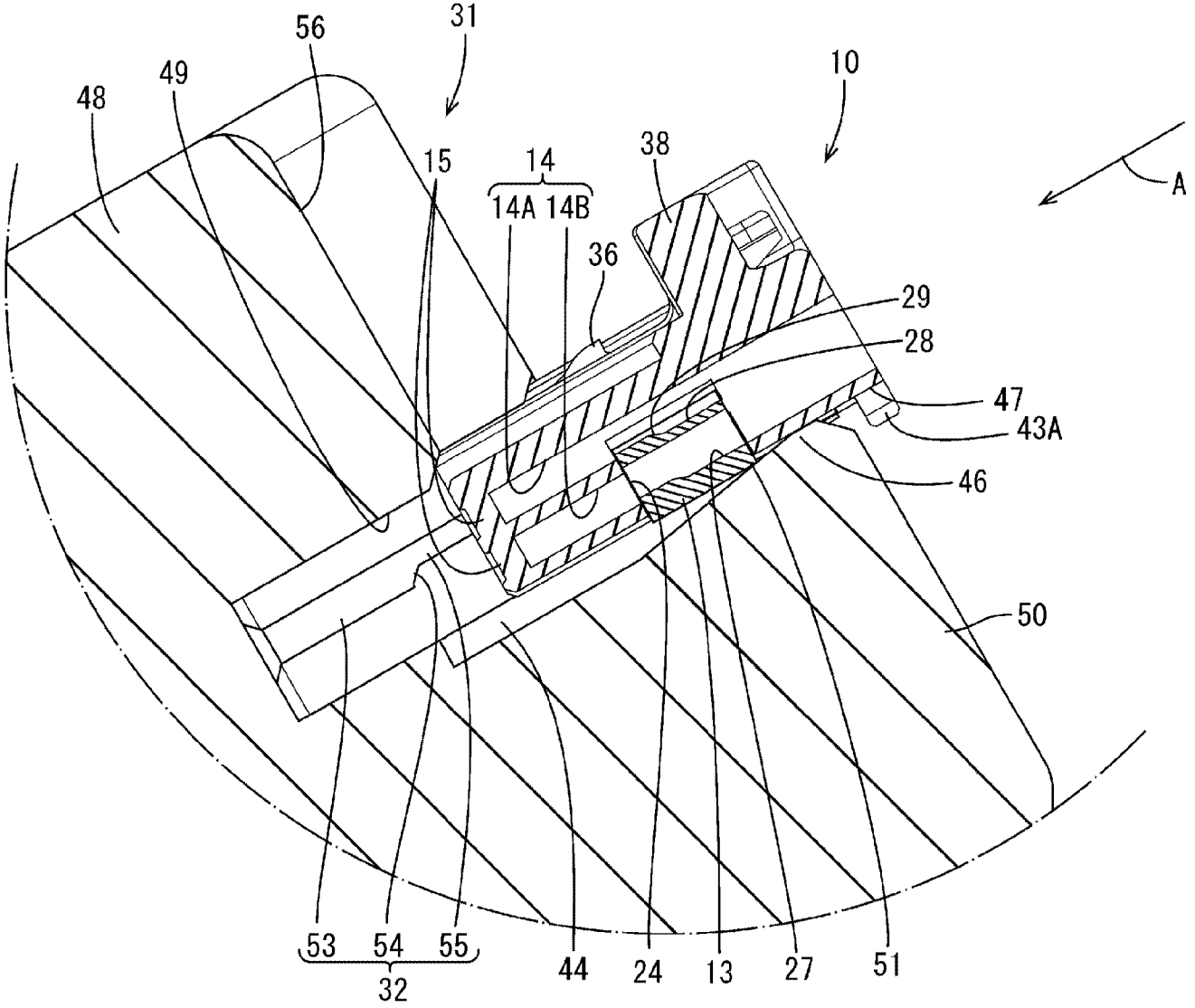
FIG. 21 is a section showing a process of pulling the connector housing out of the connector accommodation recess.

If the connector housing 12 is pulled further rearward, the second contact portions 51 of the retainer 13 come into contact with the second protrusions 46 of the jig 31 from front with respect to the inserting direction A as shown in FIG. 21. In this way, the retainer 13 is pressed upwardly by the second protrusions 46.

If the connector housing 12 is pulled further rearward, the retainer 13 moves upward by being pressed upwardly by the second protrusions 46, the lock receiving portions 33 of the retainer 13 and the partial locking portions 41 are disengaged, and the lock receiving portions 33 are resiliently deformed and ride on the full locking portions 40.

If the connector housing 12 is pulled further rearward, the retainer 13 moves further upward and the lock receiving portions 33 are restored and resiliently locked to the full locking portions 40 of the connector housing 12. In this way, the retainer 13 is held at the full locking position with respect to the connector housing 12.

With the retainer 13 held at the full locking position, the retainer 13 projects into the cavities 14 of the connector housing 12. In this way, the retainer 13 comes into contact with the connecting tube portions 18 of the female terminals 11 accommodated in the cavities 14 from behind with respect to the inserting direction A and the female terminals 11 are held in the cavities 14 while being prevented from coming out rearward.

Figure 22:
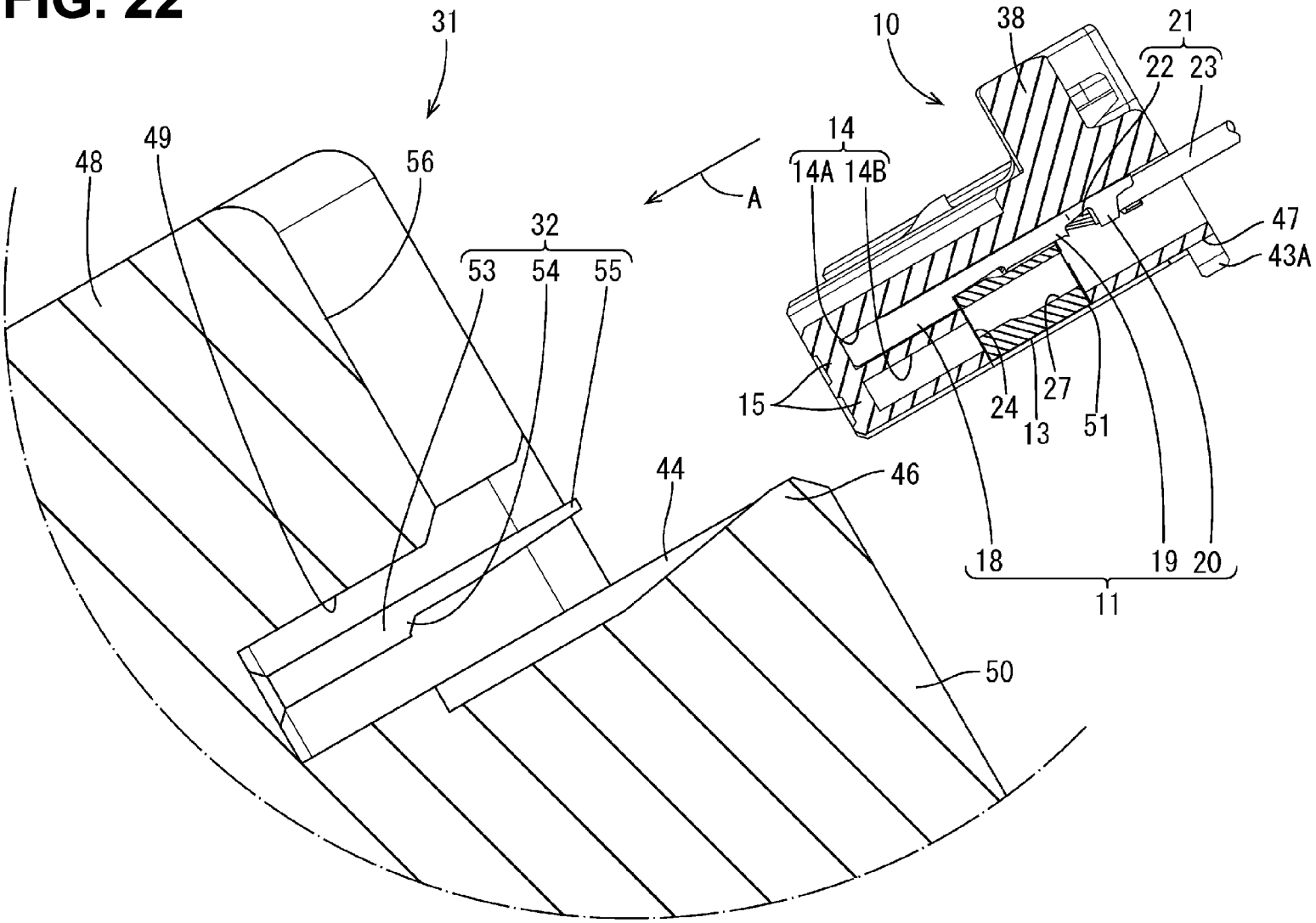
FIG. 22 is a section showing a state where the connector is pulled out of the connector accommodation recess.

As described above, with the connector housing 12 pulled out of the jig 31, the retainer 13 is held at the full locking position with respect to the connector housing 12 and the female terminals 11 are held in the cavities 14 while being prevented from coming out rearward (see FIG. 22). In this way, the connector 10 is completed.

(Functions and Effects of Embodiment)

Next, functions and effects of this embodiment are described. The connector 10 according to this embodiment is the connector 10 including the female terminals 11, the connector housing 12 having the cavities 14 into which the female terminals 11 are inserted along the inserting direction A, and the retainer 13 to be mounted into the connector housing 12 and movable between the partial locking position where the retainer 13 is retracted from the cavities 14 and the female terminals 11 are insertable into the cavities 14 and the full locking position where the retainer 13 projects into the cavities 14 to retain and lock the female terminals 11 inserted into the cavities 14, and the retainer 13 includes the first contact portions 30 configured to move the retainer 13 from the full locking position to the partial locking position by coming into contact with the tip portions 55 of the first protrusions 32 of the jig 31 and the second contact portions 51 configured to move the retainer 13 from the partial locking position to the full locking position by coming into contact with the second protrusions 46 of the jig 31.

Further, the jig 31 according to this embodiment is the jig 31 for moving the retainer 13 mounted in the connector housing 12 including the cavities 14 into which the female terminals 11 are inserted along the inserting direction A between the partial locking position where the retainer 13 is retracted from the cavities 14 and the female terminals 11 are insertable into the cavities 14 and the full locking position where the retainer 13 projects into the cavities 14 to retain and lock the female terminals 11 inserted into the cavities 14, and includes the connector accommodation recess 49 extending along the inserting direction A and configured to accommodate the connector housing 12, the first protrusions 32 provided in the front end parts of the connector accommodation recess 49 in the inserting direction A, extending rearward with respect to the inserting direction A and configured to move the retainer 13 from the full locking position to the partial locking position by coming into contact with the retainer 13, and the second protrusions 46 provided on the rear end part in the inserting direction A on the bottom wall of the connector accommodation recess 49, projecting inwardly of the connector accommodation recess 49 and configured to move the retainer 13 from the partial locking position to the full locking position by coming into contact with the retainer 13.

Further, the method for manufacturing the connector 10 according to this embodiment is a method for manufacturing the connector 10 including the female terminals 11, the connector housing 12 having the cavities 14 into which the female terminals 11 are inserted along the inserting direction A, and the retainer 13 to be mounted into the connector housing 12 and movable between the partial locking position where the retainer 13 is retracted from the cavities 14 and the female terminals 11 are insertable into the cavities 14 and the full locking position where the retainer 34 projects into the cavities 14 to retain and lock the female terminals 11 inserted into the cavities 14, and includes mounting the retainer 13 into the connector housing 12, moving the retainer 13 to the full locking position by inserting the connector housing 12 having the retainer 13 mounted therein into the connector accommodation recess 49 provided in the jig 31 to bring the first protrusions 32 provided in the front end part of the connector accommodation recess 49 in the inserting direction A and extending rearward with respect to the inserting direction A and the retainer 13 into contact, inserting the female terminals 11 into the cavities 14 along the inserting direction A, and moving the retainer 13 from the partial locking position to the full locking position by pulling the connector housing 12 having the retainer 13 and the female terminals 11 mounted therein out of the jig 31 to bring the second protrusions 46 provided in the rear end part in the inserting direction A on the side wall of the connector accommodation recess 49 and projecting inwardly of the connector accommodation recess 49 and the retainer 13 into contact.

According to this embodiment, the retainer 13 can be moved to the partial locking position by mounting the connector housing 12 assembled with the retainer 13 into the jig 31. The retainer 13 can be moved to the full locking position by removing the connector housing 12 out of the jig 31. In this way, the worker needs not operate the retainer 13 with fingers in moving the retainer 13 from the partial locking position to the full locking position, wherefore man-hours in a process of manufacturing the connector 10 can be reduced.

According to this embodiment, the connector housing 12 includes the retainer accommodation recess 24 into which the retainer 13 is mounted, the connector housing 12 includes the receiving hole portions 39 configured to receive the first protrusions 32 in the front end part located on the front side in the inserting direction A, and the hole portions 39 communicate with the retainer accommodation recess 24.

By the above configuration, the first protrusions 32 of the jig 31 are also inserted into the retainer accommodation recess 24 when being inserted into the receiving hole portions 39. In this way, the first protrusions 32 of the jig 31 can be brought into contact with the first contact portions 30 of the retainer 13 accommodated in the retainer accommodation recess 24 by a simple operation of inserting the first protrusions 32 into the receiving hole portions 39.

According to this embodiment, the connector housing 12 includes the end rib 43 projecting outward in the direction intersecting the inserting direction A on the rear end part located on the rear side in the inserting direction A, and the end rib 43 includes the second protrusion avoiding recesses 47 configured to avoid interference with the second protrusions 46.

By the above configuration, the interference of the end rib 43 of the connector housing 12 with the second protrusions 46 of the jig 31 can be suppressed in inserting the connector housing 12 into the connector accommodation recess 49 of the jig 31 and in pulling the connector housing 12 out of the connector accommodation recess 49 of the jig 31.

According to this embodiment, the jig 31 is provided with the guide rib 44 extending along the inserting direction A, and the end rib 43 includes the guide groove 45 to be engaged with the guide rib 44.

By the above configuration, the connector housing 12 is guided into the connector accommodation recess 49 along the inserting direction A by the engagement of the guide rib 44 and the guide groove 45.

According to the above embodiment, the retainer 13 is provided with the guide rib avoiding recess 34 configured to avoid interference with the guide rib 44 with the retainer 13 moved to the partial locking position.

By the above configuration, the interference of the retainer 13 and the guide rib 44 of the jig 31 can be suppressed with the retainer 13 moved to the partial locking position.

According to this embodiment, the bottom surface 42 of the guide rib avoiding recess 34 is formed to be flush with the outer surface of the connector housing 12 with the retainer 13 moved to the partial locking position.

By the above configuration, the interference of the retainer 13 and the guide rib 44 of the jig 31 can be reliably suppressed with the retainer 13 moved to the partial locking position.

According to this embodiment, the first protrusion 32 includes the base portion 53 on the front side in the inserting direction A and the tip portion 55 extending rearward with respect to the inserting direction from the base portion 53 and narrower than the base portion 53, the inclined portion 54 inclined with respect to the inserting direction A is provided between the base portion 53 and the tip portion 55, and the inclined portion 54 comes into contact with the retainer 13.

By the above configuration, the retainer 13 can be reliably moved to the partial locking position by the contact of the inclined portion 54 and the retainer 13.

According to this embodiment, the guide rib 44 extending along the inserting direction A and configured to guide the connector housing 12 into the connector accommodation recess 49 by sliding in contact with the connector housing 12 is provided on the side wall of the connector accommodation recess 49.

By the above configuration, the connector 12 can be reliably inserted into the connector accommodation recess 49 along the inserting direction A.

According to this embodiment, the second protrusions 46 are provided at the positions projecting rearward with respect to the inserting direction A from the inner surface of the connector accommodation recess 49. In this way, the second protrusions 46 and the retainer 13 can be reliably brought into contact.

Other Embodiments

The technique disclosed in this specification is not limited to the above described and illustrated embodiment. For example, the following embodiments are also included in the technical scope of the technique disclosed in this specification.

(1) Although the terminals are the female terminals 11 in the above embodiment, there is no limitation to this and the terminals may be male terminals.

(2) Although the retainer 13 is assembled with the connector housing 12 from below in the above embodiment, there is no limitation to this and the retainer 13 may be assembled with the connector housing 12 not only from below, but also from a lateral side or from above.

Although the second protrusions 46 provided on the jig 31 are provided on the bottom surface of the connector accommodation recess 49 in the above embodiment, there is no limitation to this and second protrusions may be provided at positions corresponding to the retainer 13 mounted in the connector housing 12, e.g. provided on the side wall or the upper surface of the connector accommodation recess 49.

(3) Although the connector housing 12 is provided with the receiving hole portions 39 in the above embodiment, there is no limitation to this and the receiving hole portions 39 open outward in the connector housing 12 may form groove-like receiving recesses open outward.

(4) Although the connector housing 12 is provided with the partial locking portions 41 and the retainer 13 is held at the partial locking position with respect to the connector housing 12 by locking the lock receiving portions 33 of the retainer 13 and the partial locking portions 41 in the above embodiment, there is no limitation to this and the connector housing 12 may not be provided with the partial locking portions 41.

(5) Although the jig 31 is provided with the guide rib 44 in the above embodiment, there is no limitation to this and the guide rib 44 may be omitted. Further, in this case, the guide rib avoiding recess 34 of the retainer 13 can also be omitted.

(6) Although the cavities 14 are formed in the two upper and lower stages in the above embodiment, there is no limitation to this and the cavities 14 may be formed in one, three or more stages.

(7) Although locking lances are not provided in the cavities 14 in the above embodiment, there is no limitation to this and locking lances may project into the cavities 14. In this way, the terminals are locked by the locking lances and also locked by the retainer, whereby the terminals can be doubly locked.

(8) Although the first protrusions 32 are made of metal in the above embodiment, there is no limitation to this and an arbitrary material such as synthetic resin or ceramic can be appropriately selected according to need.

LIST OF REFERENCE SIGNS

10: connector
11: female terminal
12: connector housing
13: retainer
14: cavity
24: retainer accommodation recess
30: first contact portion
31: jig
32: first protrusion
34: guide rib avoiding recess
39: receiving hole portion (receiving recess)
43: end rib
44: guide rib
45: guide groove
46: second protrusion
47: second protrusion avoiding recess
49: connector accommodation recess
51: second contact portion
53: base portion
54: inclined portion
55: tip portion

The invention claimed is:

1. A connector, comprising:

a terminal;

a connector housing including a cavity into which the terminal is inserted along an inserting direction; and a retainer to be mounted into the connector housing and movable between a partial locking position where the retainer is retracted from the cavity and the terminal is insertable into the cavity and a full locking position where the retainer projects into the cavity to retain and lock the terminal inserted into the cavity, the retainer including a first contact portion configured to move the retainer from the full locking position to the partial locking position by coming into contact with a tip portion of a first protrusion of a jig and a second contact portion configured to move the retainer from the partial locking position to the full locking position by coming into contact with a second protrusion of the jig, wherein the first contact portion and the second contact portion are provided at opposite ends of the retainer with respect to an insertion direction of the retainer.

2. The connector of claim 1, wherein:

the connector housing includes a retainer accommodation recess into which the retainer is mounted, the connector housing includes a receiving recess provided in a front end part located on a front side in the inserting direction and configured to receive the first protrusion, and the receiving recess communicates with the retainer accommodation recess.

3. The connector of claim 1, wherein the connector housing includes an end rib provided on a rear end part located on a rear side in the inserting direction and projecting outward in a direction intersecting the inserting direction, and the end rib includes a second protrusion avoiding recess configured to avoid interference with the second protrusion.

4. The connector of claim 3, wherein the jig is provided with a guide rib extending along the inserting direction, and the end rib includes a guide groove to be engaged with the guide rib.

5. The connector of claim 4, wherein the retainer is provided with a guide rib avoiding recess configured to avoid interference with the guide rib with the retainer moved to the partial locking position.

6. The connector of claim 5, wherein a bottom surface of the guide rib avoiding recess is formed to be flush with an outer surface of the connector housing with the retainer moved to the partial locking position.

7. A jig for moving a retainer mounted into a connector housing including a cavity into which a terminal is inserted along an inserting direction between a partial locking position where the retainer is retracted from the cavity and the terminal is insertable into the cavity and a full locking position where the retainer projects into the cavity to retain and lock the terminal inserted into the cavity, comprising:

a connector accommodation recess extending along the inserting direction and configured to accommodate the connector housing;

a first protrusion provided in a front end part of the connector accommodation recess in the inserting direction, extending rearward with respect to the inserting direction and configured to move the retainer from the full locking position to the partial locking position by coming into contact with the retainer; and a second protrusion provided on a rear end part in the inserting direction on a side wall of the connector accommodation recess, projecting inwardly of the connector accommodation recess and configured to move the retainer from the partial locking position to the full locking position by coming into contact with the retainer.

8. The jig of claim 7, wherein:

the first protrusion includes a base portion on a front side in the inserting direction and a tip portion extending rearward with respect to the inserting direction from the base portion and narrower than the base portion, an inclined portion inclined with respect to the inserting direction is provided between the base portion and the tip portion, and the inclined portion comes into contact with the retainer.

9. The jig of claim 7, comprising a guide rib provided on the side wall of the connector accommodation recess, extending along the inserting direction and configured to guide the connector housing into the connector accommodation recess by sliding in contact with the connector housing.

10. The jig of claim 7, wherein the second protrusion is provided at a position projecting rearward with respect to the inserting direction from an inner surface of the connector accommodation recess.

11. A method for manufacturing a connector with a terminal, a connector housing including a cavity into which the terminal is inserted along an inserting direction, and a retainer to be mounted into the connector housing and movable between a partial locking position where the retainer is retracted from the cavity and the terminal is insertable into the cavity and a full locking position where the retainer projects into the cavity to retain and lock the terminal inserted into the cavity, comprising:

mounting the retainer into the connector housing;

moving the retainer to the partial locking position by inserting the connector housing having the retainer mounted therein into a connector accommodation recess provided in a jig to bring a first protrusion provided in a front end part of the connector accommodation recess in the inserting direction and extending rearward with respect to the inserting direction and the retainer into contact;

inserting the terminal into the cavity along the inserting direction; and moving the retainer from the partial locking position to the full locking position by pulling the connector housing having the retainer and the terminal mounted therein out of the connector accommodation recess to bring a second protrusion provided on a rear end part in the inserting direction on a side wall of the connector accommodation recess and projecting inwardly of the connector accommodation recess and the retainer into contact.

* * * * *